US007690233B2

(12) United States Patent
Katagiri et al.

(10) Patent No.: US 7,690,233 B2
(45) Date of Patent: Apr. 6, 2010

(54) PORTABLE DEVICE AND MECHANICAL KEY

(75) Inventors: Toshiharu Katagiri, Aichi (JP); Takumi Tamezane, Aichi (JP); Katsushi Miwa, Aichi (JP); Jun Yamaguchi, Aichi (JP); Hironori Mizuno, Aichi (JP); Makoto Yamamoto, Aichi (JP); Takao Ogimoto, Aichi (JP)

(73) Assignee: Kabushiki Kaisha Tokai Rika Denki Seisakusho (JP)

( * ) Notice: Subject to any disclaimer, the term of this patent is extended or adjusted under 35 U.S.C. 154(b) by 241 days.

(21) Appl. No.: 11/511,670

(22) Filed: Aug. 29, 2006

(65) Prior Publication Data

US 2007/0044525 A1 Mar. 1, 2007

(30) Foreign Application Priority Data

Sep. 1, 2005 (JP) ..... 2005-253970

(51) Int. Cl.
*A45C 11/32* (2006.01)
*A47G 29/10* (2006.01)

(52) U.S. Cl. ..... 70/456 R; 70/408; 70/414; 70/430; 70/459; 206/37.5; D3/212

(58) Field of Classification Search ..... 70/395, 70/408, 414, 429, 430, 456 R, 457, 458, 459; 206/37.1–37.8; D3/207–212
See application file for complete search history.

(56) References Cited

U.S. PATENT DOCUMENTS

| | | | | |
|---|---|---|---|---|
| 2,316,655 | A * | 4/1943 | Voos | 70/456 R |
| 4,888,970 | A | 12/1989 | Kinzler | |
| 5,051,724 | A * | 9/1991 | Morrow et al. | 70/456 R |
| 5,561,331 | A * | 10/1996 | Suyama et al. | 70/456 R |
| 6,386,007 | B1 * | 5/2002 | Johnson et al. | 70/408 |
| 6,460,386 | B1 * | 10/2002 | Watanuki et al. | 70/456 R |
| 6,553,802 | B1 * | 4/2003 | Jacob | 70/456 R |
| 6,672,118 | B1 * | 1/2004 | Wright | 70/456 R |
| 7,098,791 | B2 * | 8/2006 | Okada | 70/456 R |
| 7,227,446 | B2 * | 6/2007 | Kumazaki et al. | 340/5.61 |
| 7,290,419 | B2 * | 11/2007 | Balko et al. | 70/456 R |
| 2005/0166650 | A1 * | 8/2005 | Shimura et al. | 70/456 R |

FOREIGN PATENT DOCUMENTS

| | | |
|---|---|---|
| JP | 2000-320202 | 11/2000 |
| JP | 2003-307054 | 10/2003 |
| JP | 2004-068417 | 3/2004 |

OTHER PUBLICATIONS

Chinese Office Action dated Jul. 24, 2009.

* cited by examiner

*Primary Examiner*—Peter M Cuomo
*Assistant Examiner*—Christopher Boswell
(74) *Attorney, Agent, or Firm*—Fulwider Patton LLP

(57) ABSTRACT

A portable device includes a main body, which has a mechanical key retainer, and a mechanical key, which is removably retained in the mechanical key retainer. An engagement projection extends from the mechanical key in a direction perpendicular to the direction in which the mechanical key is inserted into the mechanical key retainer. The engagement projection is formed from a resilient material. The mechanical key retainer includes an engagement recess for engaging the engagement projection when the mechanical key is retained in the mechanical key retainer. This structure reduces the size of the portable device and improves portability of the portable device.

11 Claims, 11 Drawing Sheets

PORTABLE DEVICE AND MECHANICAL KEY

BACKGROUND OF THE INVENTION

The present invention relates to a portable device and a mechanical key.

Nowadays, automobiles use remote control devices such as smart entry devices and smart ignition devices, which employ electronic key systems. More specifically, such a remote control device includes a portable device that communicates with a transceiver, which is installed in an automobile. When a person, or driver, holding the portable device approaches the automobile, the doors of the automobile are automatically unlocked. When the driver leaves the automobile while holding the portable device, the doors automatically lock. When the driver opens the door to enter the automobile while holding the portable device, the steering lock system enters an unlock state. In this state, the starting of the engine is enabled by operating an engine switch. When the driver leaves the automobile while holding the portable device, the steering lock system enters a lock state. Accordingly, the remote control device enables operations from the unlocking of the doors to the starting of the engine without having to insert a key in a key cylinder.

Japanese Laid-Open Patent Publication No. 2000-320202 describes a typical portable device used in such a remote control system. The portable device has a case accommodating a battery, which functions as a power source, a circuit board on which ICs are mounted, and a mechanical key used during emergencies such as when battery drainage occurs. When the mechanical key is not in use, a lock member keeps the mechanical key locked to the case. During an emergency such as when battery drainage occurs, the lock member unlocks the mechanical key so that the mechanical key projects out of the case. The mechanical key is then used to unlock an automobile door or start the engine.

Due to the increasing number of functions in recent electronic key systems, the number of components in a portable device has been increasing. However, the portable device is required to be compact and portable. In the portable device described in Japanese Laid-Open Patent Publication No. 2000-320202, the lock member is necessary for keeping the mechanical key locked in the case and for projecting the lock member out of the case. This increases the number of components and hinders the miniaturization of the portable device.

SUMMARY OF THE INVENTION

The present invention provides a compact portable device and mechanical key that improve portability.

One aspect of the present invention is a portable device for communication with a vehicle. The portable device includes a main body. A mechanical key retainer is formed in the main body. A mechanical key is retainable in the mechanical key retainer. The mechanical key is inserted into the mechanical key retainer in a predetermined insertion direction. The mechanical key is removable from the mechanical key retainer when retained in the mechanical key retainer. A first engagement portion engageable with the mechanical key is formed on the mechanical key retainer. A second engagement portion engageable with the first engagement portion of the mechanical key retainer is formed on the mechanical key. The first and second engagement portions are formed to extend in a direction differing from the insertion direction of the mechanical key. One of the first and second engagement portions is a recess and the other one of the first and second engagement portions is a projection.

A further aspect of the present invention is a mechanical key for retention in a portable vehicle communication device by insertion into the portable device in a predetermined insertion direction. The mechanical key is removable when retained in the portable device. The portable device includes a portable device engagement portion. The mechanical key includes a handle. A mechanical key engagement portion is formed on the handle. The mechanical key engagement portion is engageable with the portable device engagement portion. The mechanical key engagement portion is either one of a recess and a projection and is formed to extend in a direction differing from the insertion direction of the mechanical key.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
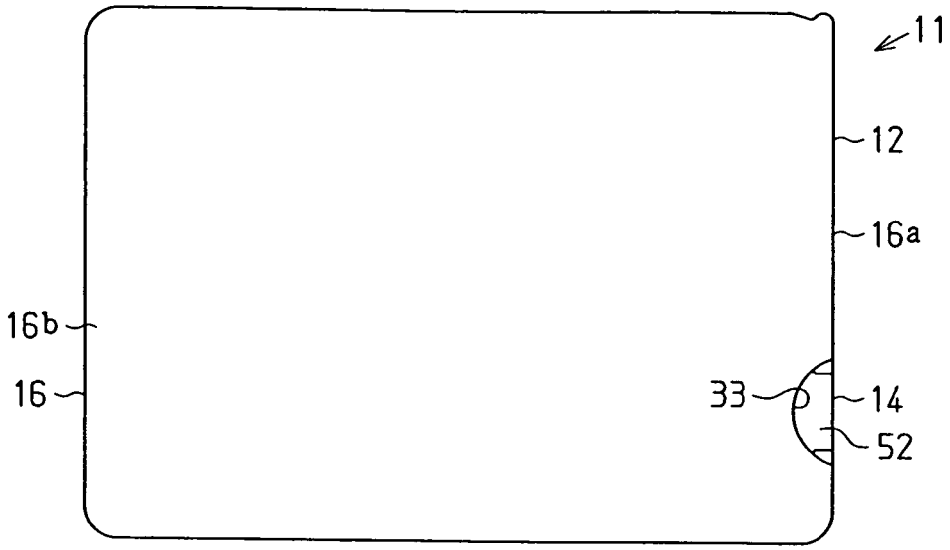
FIG. 1 is a plan view showing a portable device according to a first embodiment of the present invention.
Figure 2:
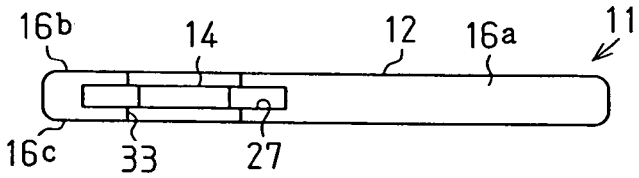
FIG. 2 is a side view showing the portable device of FIG. 1.
Figure 3:
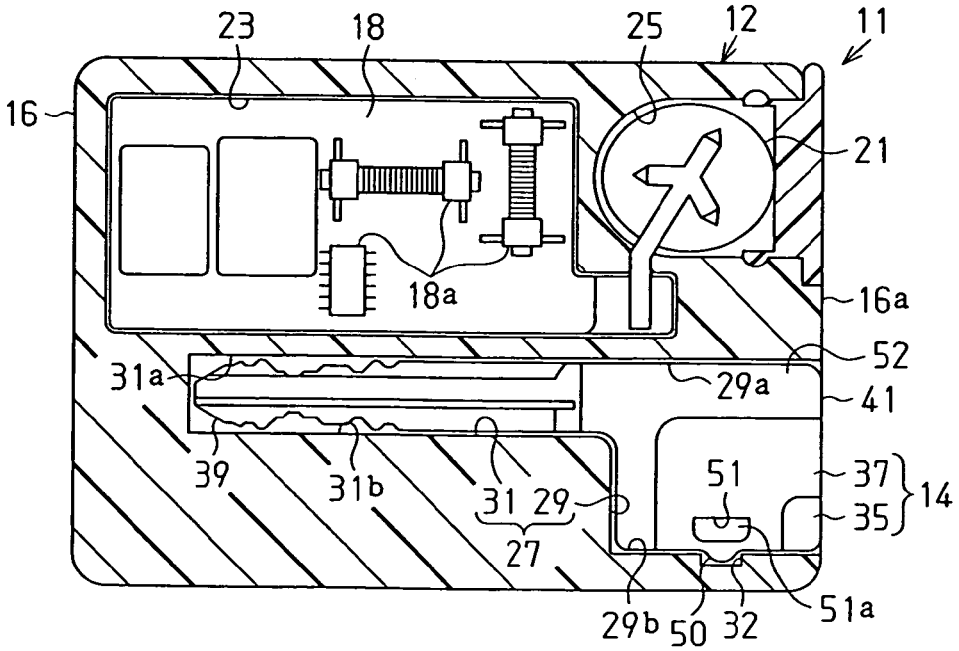
FIG. 3 is a cross-sectional view of the portable device shown in FIG. 1.

A first embodiment of the present invention will now be described with reference to FIGS. 1 to 5. Referring to FIGS. 1 and 2, a portable device 11 includes a main body 12 and a mechanical key 14, which is retained in the main body 12 in a removable manner. As shown in FIG. 3, the main body 12 includes a case 16, a circuit board 18, and a battery 21. In the present embodiment, the case 16 is formed from synthetic resin and has the form of a thin box and is card-shaped. The case 16 includes a circuit board retainer 23 and a battery retainer 25.

The case 16 has a side wall 16*a* (refer to FIG. 2) extending in a direction perpendicular to the longitudinal direction of the case 16. A mechanical key retainer 27 extends into the case 16 from the side wall 16*a* in the longitudinal direction of the case 16. The mechanical key retainer 27 is separated from the circuit board retainer 23 and the battery retainer 25. The mechanical key retainer 27 has a narrow rectangular cross-section. As shown in FIG. 3, the mechanical key retainer 27 includes a handle retaining portion 29, which is located near the side wall 16*a*, and a blade retaining portion 31, which is separated from the side wall 16*a*. The handle retaining portion 29 is formed to have a cross-sectional area that is greater than that of the blade retaining portion 31. The mechanical key retainer 27 is generally L-shaped by the retaining portions 29 and 31, which have different cross-sectional areas. The handle retaining portion 29 and the blade retaining portion 31 respectively have side walls 29*a* and 31*a*, which are flush with each other, and opposing side walls 29*b* and 31*b*, which are separated from each other.

In the handle retaining portion 29, an engagement recess 32 is formed in the side wall 29*b*. The engagement recess 32 extends parallel to the side wall 16*a* of the case 16, that is, in a direction perpendicular to the longitudinal direction of the mechanical key retainer 27. The engagement recess 32 is generally box-shaped and is located in the substantially middle part of the side wall 29*b* of the handle retaining portion 29.

As shown in FIGS. 1 and 2, the case 16 has a first cutaway portion 33, which is formed by cutting out part of the side wall 16*a*. The first cutaway portion 33 is formed to have a semi-circular cross-section and extends from an upper surface 16*b* to a lower surface 16*c* of the case 16. The cutaway portion 33 overlaps the mechanical key retainer 27.

As shown in FIG. 3, the circuit board 18 is arranged in the circuit board retainer 23. Various electronic components 18*a*, such as a recorder or a transceiver, are mounted on the circuit board 18. The battery 21 is accommodated in the battery retainer 25 so as to enable power to be supplied to the circuit board 18. The circuit board 18 and the battery 21 enables the portable device 11 to function as part of a remote controller, such as a smart entry device or a smart ignition device, for remotely controlling a vehicle (not shown).

Figure 4:
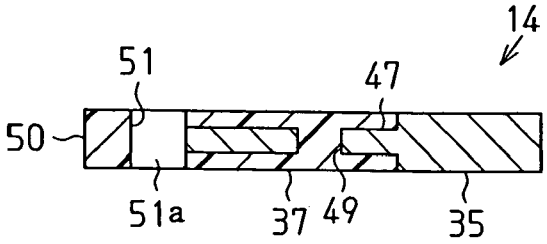
FIG. 4 is a cross-sectional view of a mechanical key of the portable device shown in FIG. 1.
Figure 5:
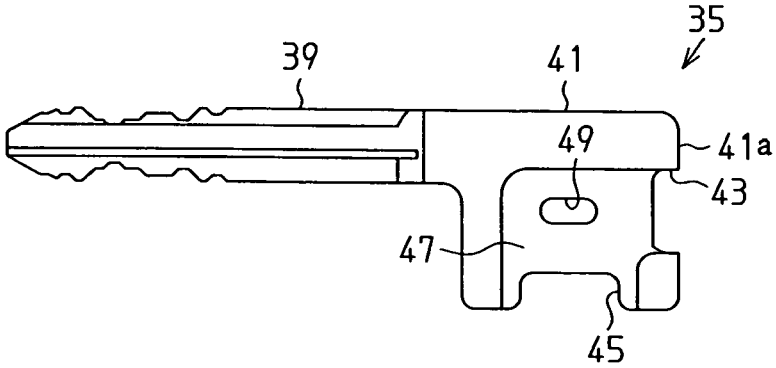
FIG. 5 is a plan view showing a key plate of the mechanical key shown in FIG. 4.

As shown in FIGS. 3 and 4, the mechanical key 14 includes a key plate 35 and a grip 37. Referring to FIG. 5, the key plate 35 is made of metal and includes a blade 39 and a handle base 41. The blade 39 is a generally rectangular plate and is sized so that it can be accommodated in the blade retaining portion 31. The blade 39 is machined (e.g., notched and grooved) to be shaped so that the mechanical key 14 functions as a key for locking and unlocking the vehicle door. The blade 39 may be shaped in any manner as long as the blade 39 may be inserted into a key cylinder (not shown) to, for example, lock or unlock a vehicle door.

The handle base 41 is a generally square plate and formed continuously with the blade 39. Thus, the blade 39 and the handle base 41 are formed from the same plate. The handle base 41 is sized so that it can be accommodated in the handle retaining portion 29 (refer to FIG. 3) with a slight gap provided between the handle base 41 and handle retaining portion 29. The handle base 41 has an end 41*a* that is flush with the side wall 16*a* of the case 16 (refer to FIG. 3) when the mechanical key 14 is accommodated in the mechanical key retainer 27. Second and third cutaway portions 43 and 45 are formed in the handle base 41. The second and third cutaway portions 43 and 45 respectively face toward the side wall 16*a* and the engagement recess 32 when the mechanical key 14 is accommodated in the mechanical key retainer 27. The second and third cutaway portions 43 and 45 are each arcuate.

The handle base 41 has a thin portion 47, which extends between the second and third cutaway portions 43 and 45. The thin portion 47 is formed so that it occupies a relatively large area of the handle base 41. An elliptic hole 49 extends through the generally middle part of the thin portion 47.

Referring to FIGS. 3 and 4, in the present embodiment, the grip 37 is formed from a resilient resin material such as an elastomer. Further, the grip 37 is formed from a material having a friction coefficient that is greater than that of the key plate 35. The grip 37 is attached to the key plate 35 so that parts of the grip 37 are fitted into the second and third cutaway portions 43 and 45, the thin portion 47, and the elliptic hole 49 (refer to FIG. 5). In the present embodiment, the grip 37 is insert-molded with the key plate 35. However, the grip 37 may be attached to the key plate 35 in any manner. Further, the grip 37 includes an engagement projection 50, which is engaged with the engagement recess 32 when the mechanical key 14 is accommodated in the mechanical key retainer 27. The engagement projection 50 is sized so that when the mechanical key 14 is inserted into the portable device 11 but not completely accommodated in the mechanical key retainer 27, the engagement projection 50 is forced against the side wall 29*b* of the handle retaining portion 29 and resiliently flexed.

An arcuate buffer opening 51 extends through the grip 37 in a manner overlapping the third cutaway portion 45 (refer to FIG. 5). The buffer opening 51 extends through the grip 37 parallel to the elliptic hole 49 (refer to FIG. 5) and is located between the engagement projection 50 and the elliptic hole 49. Accordingly, the buffer opening 51 is located opposite to the engagement projection 50 with respect to the projecting direction of the engagement projection 50. The buffer opening 51 defines a retraction cavity 51*a*. The handle base 41 and the grip 37 form a handle 52, which is plate shaped and generally has the form of a box.

To accommodate the mechanical key 14 in the mechanical key retainer 27 of the case 16, the handle 52 of the mechanical key 14 is first held between fingers. Then, the mechanical key 14 is inserted into the mechanical key retainer 27 from the blade 39 of the key plate 35. The blade 39 and the handle 52 of the mechanical key 14 respectively move into the blade retaining portion 31 and the handle retaining portion 29. While the handle 52 is moving in the handle retaining portion 29, the engagement projection 50 of the handle 52 is forced against the side wall 29*b* of the handle retaining portion 29 and resiliently flexed. This decreases resistance when the mechanical key 14 is inserted into the mechanical key retainer 27 and enables smooth movement of the mechanical key 14. When the engagement projection 50 is resiliently flexed, the cross-sectional area of the buffer opening 51 formed in the handle 52 is reduced. As a result, the engagement projection 50 is easily resiliently flexed.

Further insertion of the mechanical key 14 into the mechanical key retainer 27 arranges the blade 39 and the handle 52 in the blade retaining portion 31 and the handle retaining portion 29, respectively. When the engagement projection 50 reaches a position in the mechanical key retainer 27 where it faces toward the engagement recess 32, the engagement projection 50 is resiliently restored to its original position and enters the engagement recess 32. In this state, the engagement projection 50 is engaged with the engagement recess 32. This prevents the mechanical key 14 from falling out of the mechanical key retainer 27. As shown in FIG. 1, in this state, the handle 52 of the mechanical key 14 is partially exposed from the case 16 through the first cutaway portion 33.

To remove the mechanical key 14 from the mechanical key retainer 27, the part of the mechanical key 14 exposed from the first cutaway portion 33 of the case 16 is held between the fingers and force is applied to pull the mechanical key 14 out of the mechanical key retainer 27. As a result, force greater than the engaging force of the engagement projection 50 and engagement recess 32 is applied to the engagement projection 50. This resiliently flexes the engagement projection 50. As a result, the engagement projection 50 is disengaged from the engagement recess 32. Further application of force to the mechanical key 14 moves the mechanical key 14 in the mechanical key retainer 27 in a state in which the engagement projection 50 is resiliently flexed and then removes the mechanical key 14 from the mechanical key retainer 27.

The present embodiment has the advantages described below.

(1) When accommodating the mechanical key 14 in the mechanical key retainer 27 of the main body 12, the engagement projection 50 of the mechanical key 14 is engaged with the engagement recess 32 of the mechanical key retainer 27. Accordingly, the mechanical key 14 and the main body 12 are engaged with each other through a simple structure. Further, there is no need for a lock member. This reduces the number of components in the portable device and enables the portable device 11 to be more compact.

(2) The engagement projection 50 of the mechanical key 14 is formed from a resilient resin material such as an elastomer. Accordingly, when inserting the mechanical key 14 into the mechanical key retainer 27 of the main body 12, the engagement projection 50 is resiliently flexed when necessary to smooth the movement of the mechanical key 14.

(3) The retraction cavity 51*a* is defined adjacent to the engagement projection 50 in the mechanical key 14. Accordingly, when inserting the mechanical key 14 into the mechanical key retainer 27 of the main body 12, the engagement projection 50 is resiliently flexed so as to be retracted toward the retraction cavity 51*a*. This ensures the flexing of the engagement projection 50 and enables smooth movement of the mechanical key 14.

(4) The case 16 of the main body 12 includes the first cutaway portion 33. Accordingly, when the mechanical key 14 is accommodated in the mechanical key retainer 27, the mechanical key 14 is partially exposed from the first cutaway portion 33. As a result, the mechanical key 14 may easily be removed from the mechanical key retainer 27 by holding and pulling the exposed part.

(5) The engagement projection 50 of the mechanical key 14 has a relatively high friction coefficient and is formed integrally with the grip 37 so as to improve the grip of the mechanical key 14. Accordingly, the number of components of the mechanical key 14 is decreased, and the portable device 11 may be miniaturized thereby improving the portability of the portable device 11.

(6) The engagement projection 50 of the mechanical key 14 is formed to project in the widthwise direction of the portable device 11. Accordingly, the engagement projection 50 does not increase the thickness of the portable device 11.

A second embodiment of the present invention will now be described with reference to FIGS. 6 to 13. To avoid redundancy, like or same reference numerals are given to those components that are the same as the corresponding components of the first embodiment.

Figure 6:
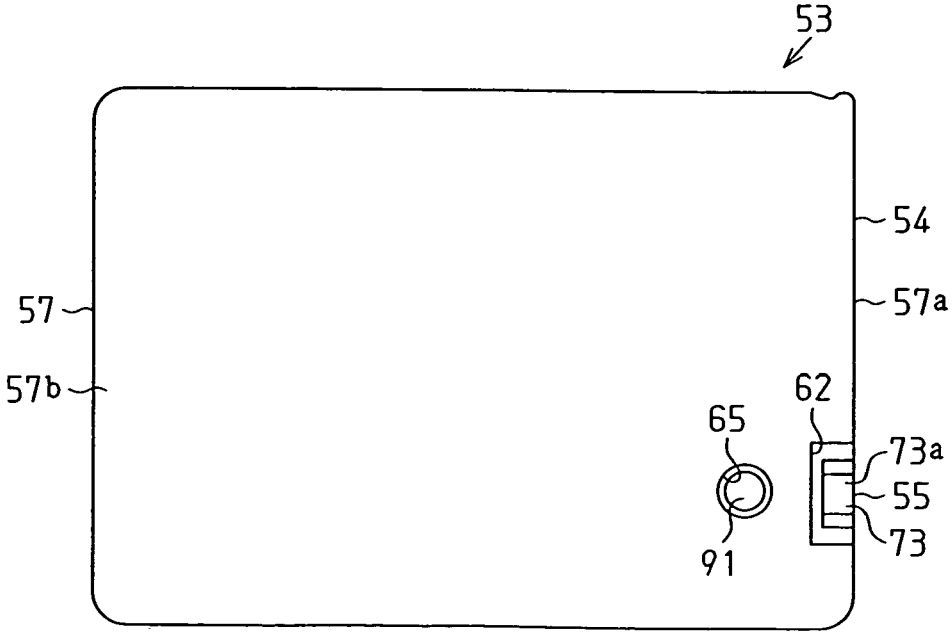
FIG. 6 is a plan view showing a portable device according to a second embodiment of the present invention.
Figure 7:
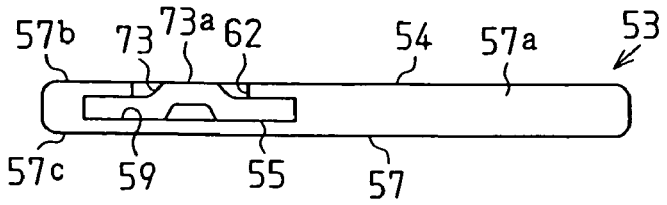
FIG. 7 is a side view showing the portable device of FIG. 6.
Figure 8:
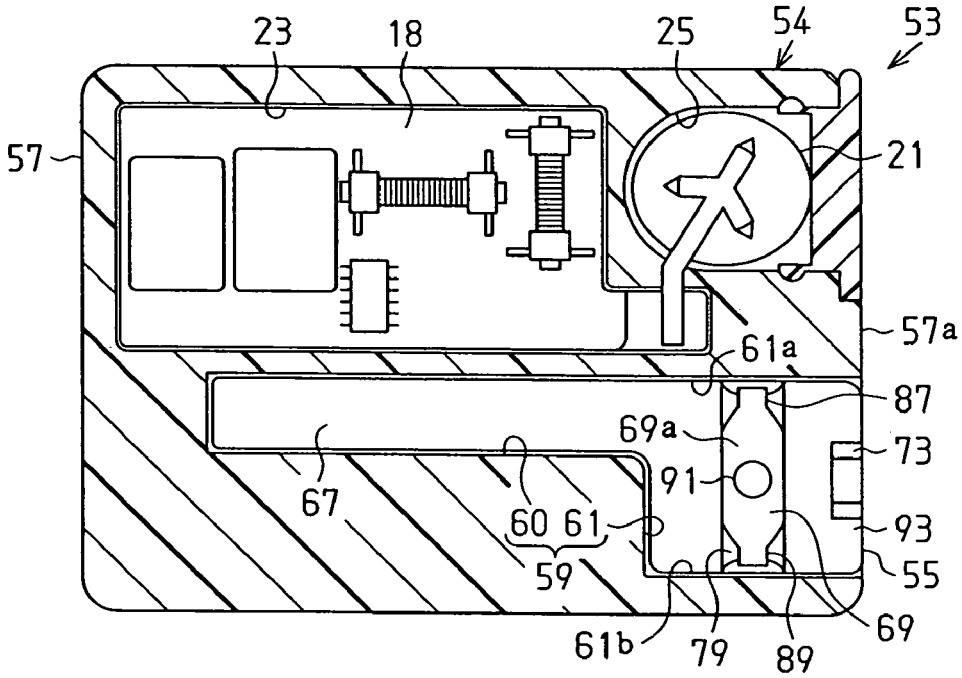
FIG. 8 is a cross-sectional view of the portable device shown in FIG. 6.

As shown in FIGS. 6 to 8, in the same manner as the first embodiment, a portable device 53 of the present embodiment includes a main body 54 and a mechanical key 55. As shown in FIG. 8, the main body 54 includes a case 57, a circuit board 18, and a battery 21. In the same manner as the case 16 of the first embodiment, the case 16 is card-shaped and includes a circuit board retainer 23 and a battery retainer 25. Further, the case 57 includes a mechanical key retainer 59. The mechanical key retainer 59 does not have the engagement recess 32 that is formed in the mechanical key retainer 27 of the first embodiment. In the same manner as the first embodiment, the mechanical key retainer 59 includes a blade retaining portion 60 and a handle retaining portion 61.

As shown in FIGS. 6 and 7, the case 57 includes a fourth cutaway portion 62 formed in a side wall 57*a* of the case 57. The fourth cutaway portion 62 is formed by cutting away only the upper wall 57*b* of the mechanical key retainer 59 from the side wall 57*a*. Further, the fourth cutaway portion 62 is formed to have a cross-section that is rectangular when viewing the upper wall 57*b* towards the lower wall 57*c*. One straight side in the cross-section of the fourth cutaway portion 62 lies along the side wall 57*a*. As shown in FIG. 6, an engagement window 65, which functions as an engagement recess, is formed in the case 57. The engagement window 65 extends through the upper wall 57*b* into the handle retaining portion 61 (refer to FIG. 8) of the mechanical key retainer 59. The engagement window 65 has a circular cross-section and is located at the substantially middle part of the handle retaining portion 61.

Figure 9:
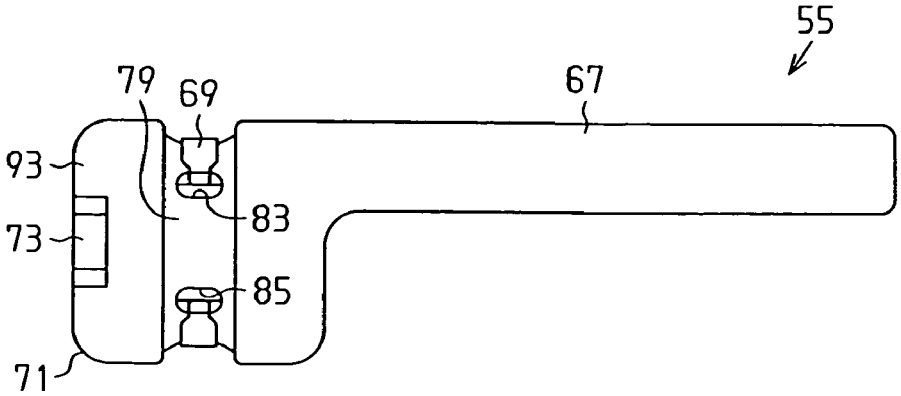
FIG. 9 is a bottom view showing a mechanical key of the portable device shown in FIG. 6.
Figure 10:
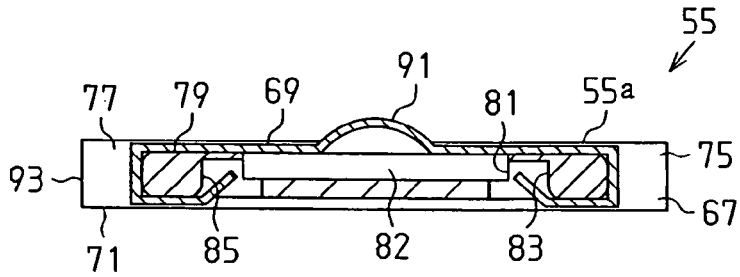
FIG. 10 is a cross-sectional view of the mechanical key shown in FIG. 9.
Figure 11:
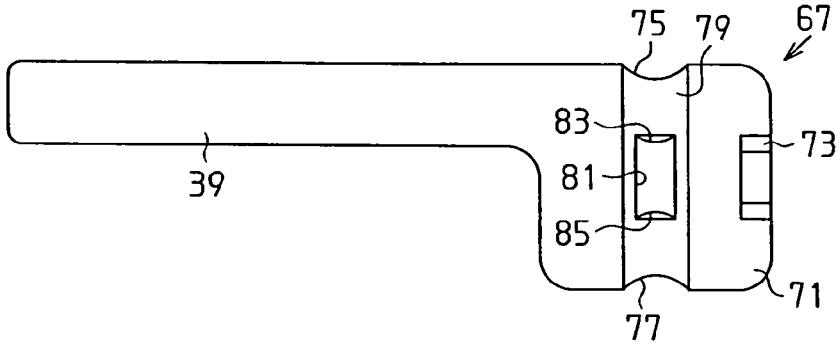
FIG. 11 is a plan view showing a key plate of the mechanical key shown in FIG. 9.

As shown in FIGS. 8 to 10, in the present embodiment, the mechanical key 55 includes a key plate 67 and a metal engagement plate 69. Referring to FIG. 11, in the same manner as the key plate 35 of the first embodiment, the key plate 67 is made of metal and includes a blade 39 and a handle base 71. Further, in the same manner as the first embodiment, although not shown in the drawings, the blade 39 is machined (notched and grooved).

The handle base 71 does not have the second and third cutaway portions 43 and 45, the thin portion 47, and the elliptic hole 49 of the handle base 41 in the first embodiment. As shown in FIGS. 6 and 7, the handle base 71 includes a bent portion 73. The bent portion 73 is peak-shaped and has a top surface 73*a*. Further, the bent portion 73 is shaped and sized so that when the mechanical key 55 is accommodated in the mechanical key retainer 59, a slight clearance is formed between the bent portion 73 and the fourth cutaway portion 62. When the mechanical key 55 is accommodated in the mechanical key retainer 59, the top surface 73*a* of the bent portion 73 is flush with the upper wall 57*b* of the case 57.

As shown in FIG. 11, the handle base 71 includes fifth and sixth cutaway portions 75 and 77. When the mechanical key 55 is accommodated in the mechanical key retainer 59 (refer to FIG. 8), the fifth and sixth cutaway portions 75 and 77 respectively faces towards a first side wall 61*a* and a second side wall 61*b* of the handle retaining portion 61. The fifth and sixth cutaway portions 75 and 77 are located in the substantially middle part of the handle base 71 with respect to the insertion direction of the mechanical key 55 and are each arcuate.

The handle base 71 includes a thin portion 79, which is thin and extends between the fifth and sixth cutaway portions 75 and 77. Further, the handle base 71 includes a generally box-shaped retraction recess 81, which is located in the middle part of the handle base 71. When the mechanical key 55 is accommodated in the mechanical key retainer 59, the retraction recess 81 faces towards the upper wall 57*b* of the case 57. As shown in FIG. 10, the retraction recess 81 defines a generally box-shaped retraction cavity 82.

As shown in FIGS. 9 to 11, the handle base 71 includes two fastening wells 83 and 85. The fastening wells 83 and 85 are located in the thin portion 79 of the handle base 71. When the mechanical key 55 is accommodated in the mechanical key retainer 59, the fastening wells 83 and 85 face towards the lower wall 57*c* (refer to FIG. 7) of the case 57. The fastening wells 83 and 85 are aligned in a direction perpendicular to the insertion direction of the mechanical key 55. As shown in FIGS. 10 and 11, the fastening wells 83 and 85 are in partial communication with the retraction recess 81.

Figure 12:
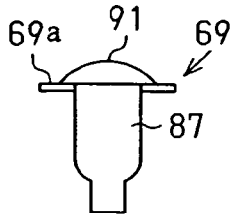
FIG. 12 is a front view showing an engagement plate of the portable device shown in FIG. 6.
Figure 13:
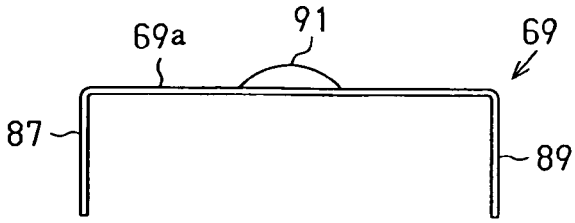
FIG. 13 is a side view showing the engagement plate of FIG. 12.

Referring to FIGS. 8, 12, and 13, the engagement plate 69 is made of a thin, resilient belt-shaped plate. The engagement plate 69 includes a generally rectangular main piece 69*a* and two engagement pieces 87 and 89, which extend from the opposite sides of the main piece 69*a* and have narrowed ends. The engagement plate 69 is formed so that the main piece 69*a* is slightly narrower than the thin portion 79 (refer to FIG. 11) of the handle base 71. A spherical portion 91, which functions as an engagement projection, projects from the middle portion of the main piece 69*a*. The engagement pieces 87 and 89 are bent in a direction opposite to the projecting direction of the spherical portion 91 so as to be orthogonal to the main piece 69*a*. In the present embodiment, the engagement plate 69 is formed through pressing.

The engagement plate 69 is hooked and fastened to the thin portion 79 of the key plate 67 as shown in FIGS. 8 to 10. More specifically, the main piece 69*a* of the engagement plate 69 is overlapped with the retraction recess 81 of the key plate 67. The engagement pieces 87 and 89 of the engagement plate 69 are bent along the thin portion 79 and engaged with the fastening wells 83 and 85. In this manner, the engagement plate 69 is fastened to the handle base 71 of the key plate 67 to form a handle 93 of the mechanical key 55. As shown in FIG. 10, the spherical portion 91 is most projected from the upper surface 55*a* of the mechanical key 55. Further, as shown in FIG. 6, the spherical portion 91 is positioned and sized to engage with the engagement window 65 of the case 57 when the mechanical key 55 is accommodated in the case 57.

To insert the mechanical key 55 into the mechanical key retainer 59 of the case 57, the handle 93 of the mechanical key 55 is first held with the fingers. The mechanical key 55 is then inserted into the mechanical key retainer 59 from the blade 39 of the key plate 67. As the mechanical key 55 moves inside the mechanical key retainer 59, the spherical portion 91 of the handle 93 is forced against the wall surface of the mechanical key retainer 59. This resiliently flexes the spherical portion 91 of the engagement plate 69 and its periphery. Thus, the spherical portion 91 and its periphery move into the retraction recess 81. Accordingly, the engagement plate 69 is resiliently flexed into the retraction recess 81 without any interference. As a result, the resistance produced between the mechanical key 55 and the mechanical key retainer 59 is lowered. Thus, the movement of the mechanical key 55 is smooth.

Further insertion of the mechanical key 55 into the mechanical key retainer 59 accommodates the blade 39 and the handle 93 respectively in the blade retaining portion 60 and the handle retaining portion 61. Further, the spherical portion 91 of the engagement plate 69 is moved until reaching a position where it faces toward the engagement window 65. At this position, the spherical portion 91 enters the engagement window 65 and resiliently restores the engagement plate 69 to its original shape. In this state, the spherical portion 91 is engaged with the engagement window 65 so as to prevent the mechanical key 55 from falling out of the mechanical key retainer 59. Further, as shown in FIG. 6, the bent portion 73 of the mechanical key 55 and its periphery is exposed from the fourth cutaway portion 62 of the case 57.

To remove the mechanical key 55 from the mechanical key retainer 59, force for pulling out the mechanical key 55 from the mechanical key retainer 59 is applied with the user's fingers to the bent portion 73 exposed from the fourth cutaway portion 62. When the applied force becomes greater than the engaging force between the spherical portion 91 and the engagement window 65, the spherical portion 91 and its periphery are resiliently flexed. This disengages the spherical portion 91 from the engagement window 65. Further application of force to the mechanical key 55 moves the mechanical key 55 in the mechanical key retainer 59 with the spherical portion 91 and its periphery in a resiliently flexed state until the mechanical key 55 is removed from the mechanical key retainer 59.

The present embodiment has the advantages described below.

(7) When the mechanical key 55 is accommodated in the main body 54 of the mechanical key 55, the spherical portion 91 arranged on the engagement plate 69 of the mechanical key 55 is engaged with the engagement window 65 of the mechanical key retainer 59. Accordingly, the engagement of the mechanical key 55 and the main body 54 is enabled with a simple structure, and the need for a locking means is eliminated. This reduces the number of components in the portable device 53, enables miniaturization, and improves portability.

(8) The engagement plate 69, which includes the spherical portion 91, is formed from a resilient metal. Accordingly, when accommodating the mechanical key 55 in the mechanical key retainer 59 of the main body 54, the spherical portion 91 and its periphery are resiliently flexed when necessary so that the mechanical key 55 moves smoothly. Further, since the engagement plate 69 is made of metal, the engagement plate 69 has higher durability compared to when the engagement plate 69 is made of a resin. This further ensures the engagement between the mechanical key 55 and the main body 54.

(9) The mechanical key 55 includes the retraction cavity 82. Accordingly, when inserting the mechanical key 55 into the mechanical key retainer 59 of the main body 54, the spherical portion 91 and its periphery, which are resiliently flexed, enter the retraction cavity 82. This ensures resilient flexing of the spherical portion 91 and its periphery and enables the mechanical key 55 to move further smoothly.

(10) The case 57 of the main body 54 includes the fourth cutaway portion 62. Accordingly, when the mechanical key 55 is accommodated in the mechanical key retainer 59, the mechanical key 55 is partially exposed from the fourth cutaway portion 62. By pulling this exposed part, the mechanical key 55 is easily removed from the mechanical key retainer 59.

(11) The engagement window 65, which communicates the mechanical key retainer 59 with the exterior of the main body 54, is formed for engagement with the mechanical key 55. The engagement window 65, which is a hole extending through the main body 54, is easy to form and has a simple shape. This contributes to the miniaturization of the portable device 53.

(12) When the mechanical key 55 is accommodated in the mechanical key retainer 59, the spherical portion 91 is exposed to the exterior through the engagement window 65. Accordingly, the accommodation of the mechanical key 55 in the mechanical key retainer 59 may easily be confirmed by checking whether or not the spherical portion 91 is exposed through the engagement window 65.

A third embodiment of the present invention will now be described with reference to FIGS. 14 to 18. To avoid redundancy, like or same reference numerals are given to those components that are the same as the corresponding components of the first and second embodiments.

Figure 14:
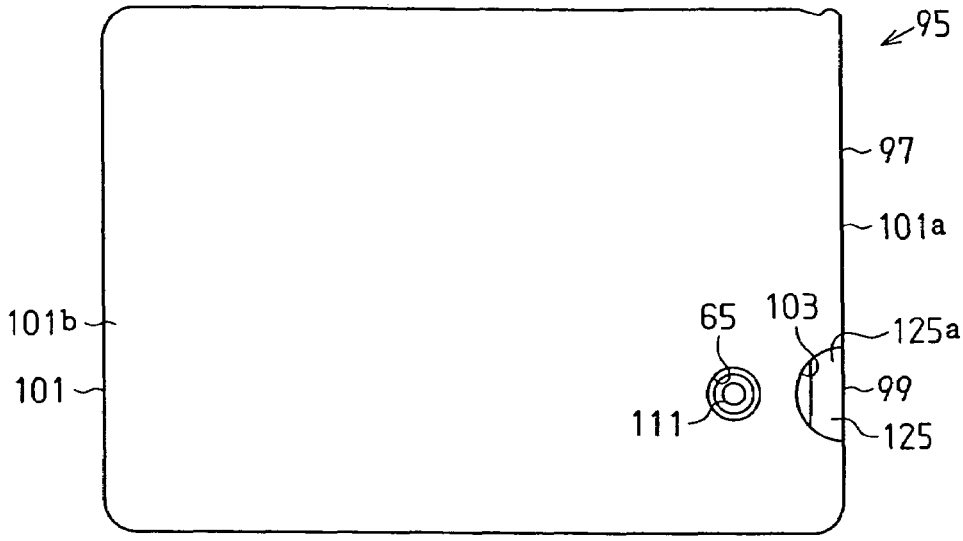
FIG. 14 is a plan view showing a portable device according to a third embodiment of the present invention.
Figure 15:
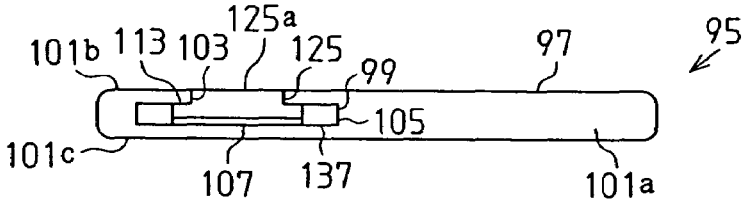
FIG. 15 is a side view showing the portable device of FIG. 14.
Figure 16:
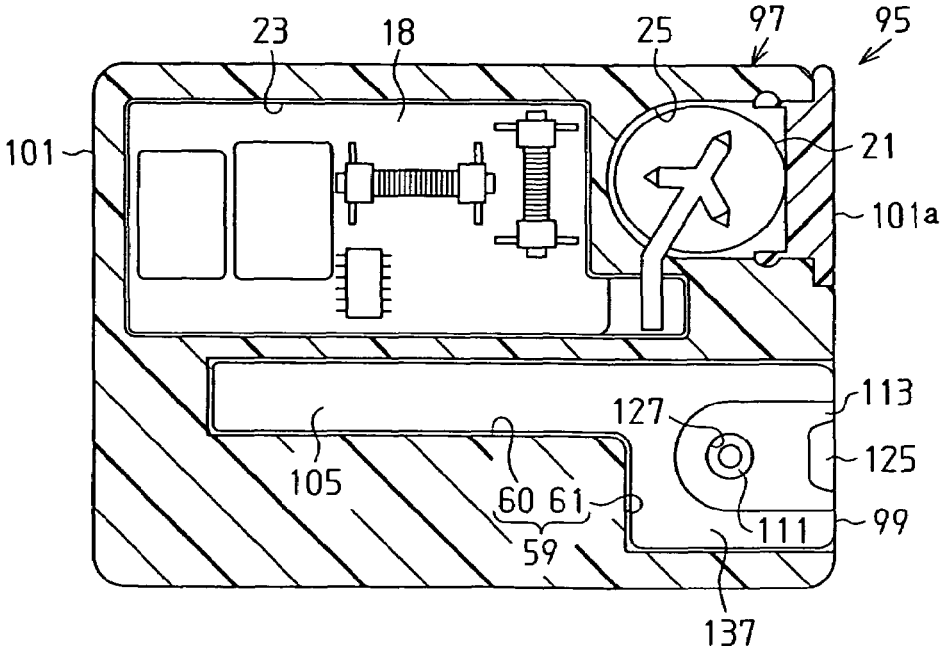
FIG. 16 is a cross-sectional view of the portable device shown in FIG. 14.

As shown in FIGS. 14 and 15, in the same manner as the above embodiments, a portable device 95 of the present embodiment includes a main body 97 and a mechanical key 99. As shown in FIG. 16, the main body 97 includes a case 101, a circuit board 18, and a battery 21. In the same manner as in the above embodiments, the case 101 is card-shaped and includes a circuit board retainer 23 and a battery retainer 25. Further, the case 57 includes a mechanical key retainer 59, which is similar to that of the second embodiment. The mechanical key retainer 59 includes a blade retaining portion 60 and a handle retaining portion 61.

Further, as shown in FIGS. 14 and 15, the case 101 includes a seventh cutaway portion 103 formed in a side wall 101*a* of the case 101 at the same position as the fourth cutaway portion 62 of the second embodiment. The seventh cutaway portion 103 is formed by cutting away only the upper wall 101*b* of the mechanical key retainer 59 from the side wall 101*a*. Further, the fourth cutaway portion 62 is formed to have a cross-section that is semicircular when viewing the upper wall 101*b* towards the lower wall 101*c*. One straight side in the cross-section of the seventh cutaway portion 103 lies along the side wall 101*a*. As shown in FIG. 14, an engagement window 65, which functions as an engagement recess, is formed in the case 101 in the same manner as in the second embodiment.

Figure 17:
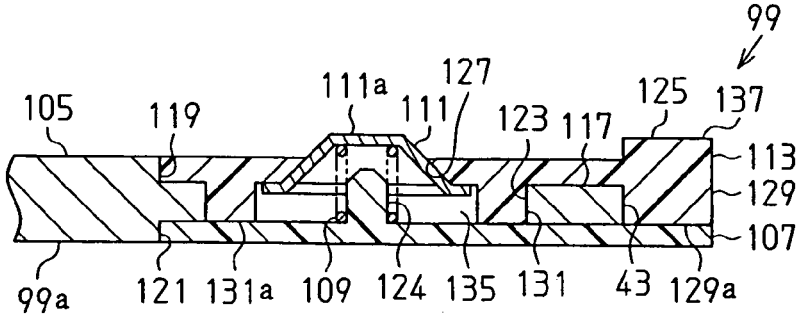
FIG. 17 is a cross-sectional view of a mechanical key of the portable device shown in FIG. 14.
Figure 18:
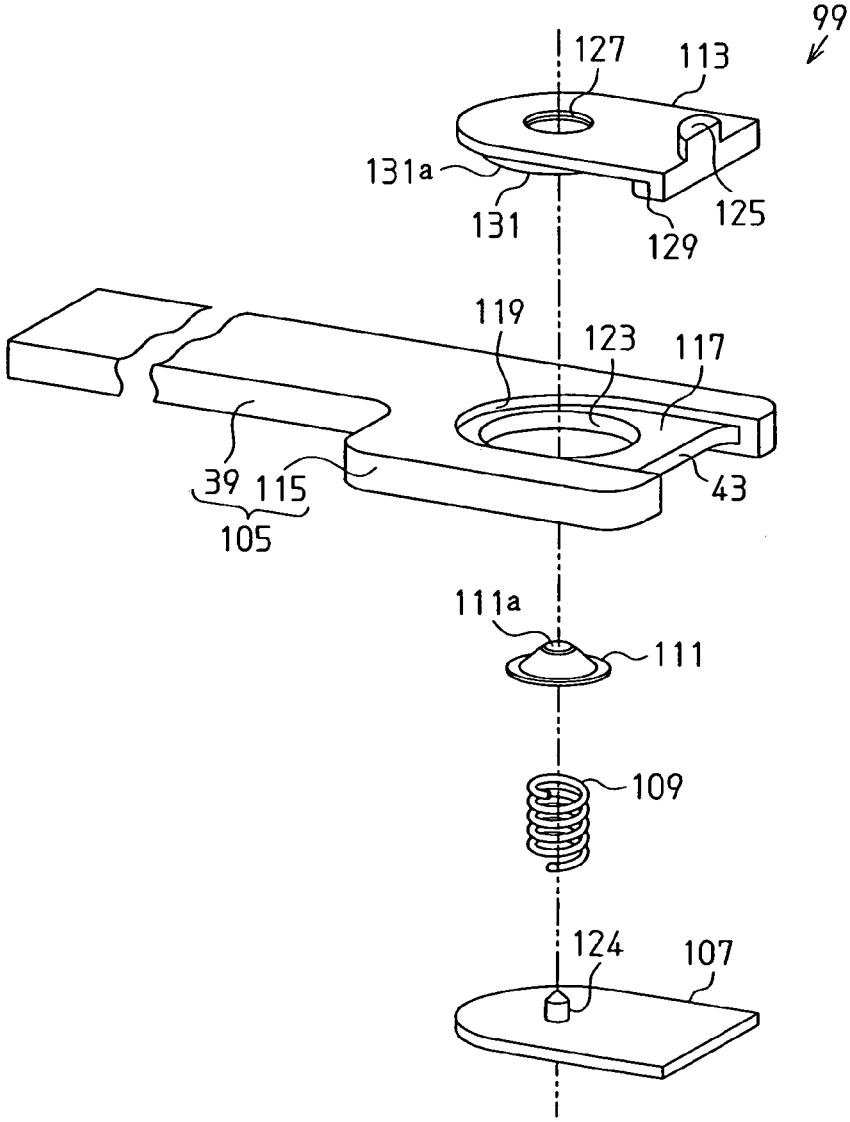
FIG. 18 is an exploded perspective view showing the mechanical key of FIG. 17.

As shown in FIGS. 16 to 18, in the preferred embodiment, the mechanical key 99 includes a key plate 105, a lower grip member 107, a spring 109, a hook 111, and an upper grip member 113. As shown in FIG. 18, in the same manner as the above embodiments, the key plate 105 is made of metal and includes a blade 39 and a handle base 115. Further, in the same manner as the first embodiment, although not shown in the drawings, the blade 39 is machined (notched and grooved).

The handle base 115 does not have the third cutaway portion 45, the thin portion 47, and the elliptic hole 49 of the handle base 41 in the first embodiment. However, the handle base 115 includes the second cutaway portion 43 of the first embodiment. The handle base 115 has a bell-shaped thin portion 117, which extends from the second cutaway portion 43 in the insertion direction of the mechanical key 99.

As viewed in FIG. 17, a bell-shaped upper fitting pit 119 and lower fitting pit 121 are defined on opposite sides of the thin portion 117. When the mechanical key 99 is accommodated in the mechanical key retainer 59, the upper fitting pit 119 and the lower fitting pit 121 are arranged respectively facing towards the upper wall 101*b* and the lower wall 101*c* of the case 101 (refer to FIG. 15). As shown in FIGS. 17 and 18, the handle base 115 includes a fitting hole 123 extending through the thin portion 117. When the mechanical key 99 is accommodated in the mechanical key retainer 59 (refer to FIG. 16), the fitting hole 123 is in concentric alignment with the engagement window 65 (refer to FIG. 14).

The lower grip member 107 is a bell-shaped plate made of resin and formed to fit into the lower fitting pit 121 of the key plate 105. When the lower grip member 107 is fitted in the lower fitting pit 121, the lower grip member 107 fills the lower fitting pit 121 and is flush with the lower surface 99*a* of the mechanical key 99. Further, a support projection 124 projects from the lower grip member 107. The support projection 124 includes a cylindrical lower portion and a conical higher portion. The support projection 124 is much smaller than the fitting hole 123 of the key plate 105. When the lower grip member 107 is fitted into the lower fitting pit 121 of the key plate 105, the support projection 124 is in concentric alignment with the fitting hole 123 of the key plate 105.

In the present embodiment, the spring 109 is a compression spring and has a constant diameter. The spring 109 is sized so that it may be fitted to the support projection 124 of the lower grip member 107. Accordingly, the spring 109 is located inside the fitting hole 123 of the key plate 105 in the mechanical key 99.

The hook 111, which functions as an engagement projection, is made of extremely thin metal and has a flat and circular top surface 111*a*. The top surface 111*a* has a diameter than is smaller than that of the engagement window 65 of the case 101 (refer to FIG. 14). Further, in the mechanical key 99, the hook 111 is arranged on the spring 109, and the spring 109 is in contact with the inner side of the hook 111 under the top surface 111*a*.

The upper grip member 113 is a bell-shaped plate made of a resin and formed to fit into the upper fitting pit 119 of the key plate 105. When the upper grip member 113 is fitted in the upper fitting pit 119, the upper grip member 113 fills the upper fitting pit 119. A gripping projection 125, which has a generally trapezoidal cross-section when viewing the mechanical key 99 from above, projects from the upper grip member 113 away from the key plate 105. As shown in FIGS. 14 and 15, the gripping projection 125 is shaped and sized so that it is arranged in the seventh cutaway portion 103 with a slight clearance formed between the gripping projection 125 and the seventh cutaway portion 103 when the mechanical key 99 is accommodated in the mechanical key retainer 59 (refer to FIG. 16). Further, the upper surface 125*a* of the gripping projection 125 is flush with the upper wall 101*b* of the case 101 when the mechanical key 99 is accommodated in the mechanical key retainer 59.

As shown in FIGS. 17 and 18, a spring hole 127 extends through the upper grip member 113. The spring hole 127 has a diameter that is smaller than that of the fitting hole 123 of the key plate 105. When the upper grip member 113 is fitted into the upper fitting pit 119 of the key plate 105, the spring hole 127 is in concentric alignment with the fitting hole 123. Further, the wall extending around the spring hole 127 is formed so that its diameter decreases as the key plate 105 becomes farther. The diameter of the spring hole 127 is greater than the diameter at the top surface 111*a* of the hook 111 but smaller than the diameter at the largest part of the hook 111.

The upper grip member 113 further includes fused projections 129 and 131 projecting toward the key plate 105. The first fused projection 129 is formed to have an arcuate cross-section when viewing the mechanical key 99 from above. When the upper grip member 113 is fitted into the upper fitting pit 119, the first fused projection 129 is shaped and positioned to be engaged with the second cutaway portion 43. Further, the first fused projection 129 has a lower surface 129*a*, which is sized to abut against the lower grip member 107. In the present embodiment, the lower surface 129*a* of the first fused projection 129 is fused to the lower grip member 107.

The second fused projection 131 has an annular cross-section when viewing the mechanical key 99 from above. The second fused projection 131 has an outer diameter, which is substantially equal to the inner diameter of the fitting hole 123 in the key plate 105, and an inner diameter, which is greater than that of the spring hole 127 and smaller than that of the fitting hole 123. When the upper grip member 113 is fitted to the upper fitting pit 119 of the key plate 105, the second fused projection 131 is fitted into the fitting hole 123 of the key plate. Further, the second fused projection 131 has a lower surface 131*a* that abuts against the lower grip member 107. In the present embodiment, the lower surface 131*a* of the second fused projection 131 is fused to the lower grip member 107.

Accordingly, as shown in FIG. 17, a retraction cavity 135 having a circular cross-section is formed in the second fused projection 131 above the lower grip member 107. In a state in which the spring 109 and hook 111 are arranged on the lower grip member 107, which is fitted to the key plate 105, the upper grip member 113 is fitted to the key plate 105. As a result, the hook 111 is inserted through the spring hole 127 of the upper grip member 113. The largest portion of the hook 111 is larger than the spring hole 127. Thus, only part of the hook 111 including the top surface 111*a* is exposed from the mechanical key 99. The spring 109 urges the hook 111 outward through the spring hole 127. The upper grip member 113 and the lower grip member 107 are attached to the key plate 105 through insert molding. However, the upper grip member 113 and the lower grip member 107 may be attached to the key plate 105 in any way other than insert molding. In the mechanical key 99, the handle base 115, the lower grip member 107, the spring 109, the hook 111, and the upper grip member 113 form a handle 137.

To insert the mechanical key 99 into the mechanical key retainer 59 of the case 101, the handle 137 of the mechanical key 99 is first held with the fingers, and the mechanical key 99 is inserted into the mechanical key retainer 59 from the blade 39 of the key plate 105. As the mechanical key 99 moves in the mechanical key retainer 59, the hook 111, which is urged to project outwards, is forced against the wall surface of the mechanical key retainer 59. As a result, the hook 111 is moved toward the retraction cavity 135 of the mechanical key 55 against the urging force of the spring 109. This lowers resistance when the mechanical key 99 is inserted into the mechanical key retainer 59 and enables smooth movement of the mechanical key 99. In this state, the hook 111 is resiliently flexed and displaced from its original position.

Further insertion of the mechanical key 99 into the mechanical key retainer 59 arranges the blade 39 and the handle 137 respectively in the blade retaining portion 60 and the handle retaining portion 61. Then, the hook 111 of the mechanical key 99 reaches a position where the hook 111 faces toward the engagement window 65 of the case 101. The urging force of the spring 109 engages the hook 111 with the engagement window 65 and resiliently restores the hook 111 at its original position. This prevents the mechanical key 99 from falling out of the mechanical key retainer 59. In this state, as shown in FIG. 14, the gripping projection 125 is engaged with and exposed from the seventh cutaway portion 103 of the case 101.

To remove the mechanical key 99 from the mechanical key retainer 59, the gripping projection 125 exposed from the seventh cutaway portion 103 is held with the fingers to apply force to the mechanical key 99 for removing the mechanical key 99 from the mechanical key retainer 59. As a result, force greater than the engaging force of the hook 111 and the engagement window 65 is applied to the hook 111. This resiliently flexes the hook 111 into the retraction cavity 135 against the urging force of the spring 109 and disengages the hook 111 from the engagement window 65. Further application of force to the mechanical key 99 moves the mechanical key 99 in the mechanical key retainer 59 with the hook 111 located in the retraction cavity 135 until the mechanical key 99 is removed from the mechanical key retainer 59.

The present embodiment has the advantages described below.

(13) When the main body 97 of the mechanical key 99 is accommodated in the mechanical key retainer 59, the hook 111 arranged in the mechanical key 99 is engaged with the spring hole 127. Accordingly, the engagement of the mechanical key 99 and the main body 97 is enabled with a simple structure, and the need for a locking means is eliminated. This reduces the number of components in the portable device 95, enables miniaturization, and improves portability.

(14) The hook 111 and the spring 109, which function as an engagement projection, are arranged on the mechanical key 99. The engagement window 65, which functions as an engagement recess, is arranged on the main body 97. Accordingly, although the engagement projection, which has a rather complicated structure, is arranged on the mechanical key 99, the engagement recess is formed by merely forming a hole that extends through the main body 97. This simplifies the structure of the main body 97, enables miniaturization of the portable device 95, and improves portability.

(15) The engagement projection of the mechanical key 99 is formed by the hook 111 and the spring 109, which are resilient. Accordingly, in comparison to when forming the projection from only a resilient resin, such as an elastomer, the resilient force of the spring 109, which has high durability, further ensures movement of the engagement projection. As a result, the engagement force between the mechanical key 99 and the main body 97 is further ensured.

(16) The engagement projection of the mechanical key 99 is formed by arranging the spring 109 in the hook 111. When the spring 109 is resiliently flexed and compressed, the hook 111 is moved inward. Accordingly, the space required for the hook 111 and the spring 109 in the mechanical key 99 is reduced. This further ensures miniaturization of the portable device 95.

(17) The retraction cavity 135 is adjacent to the hook 111 in the mechanical key 99. Accordingly, when the mechanical key 99 is accommodated in the mechanical key retainer 59, the hook 111 is resiliently flexed and moved into the retraction cavity 135. The movement of the hook 111 ensures smooth movement of the mechanical key 99.

(18) The case 101 of the main body 97 includes the seventh cutaway portion 103. Accordingly, when the mechanical key 99 is accommodated in the mechanical key retainer 59, part of the mechanical key 99 is exposed from the seventh cutaway portion 103. As a result, by holding and applying force to the exposed part, the mechanical key 99 may easily be removed from the mechanical key retainer 59.

(19) The engagement window 65, which communicates the mechanical key retainer 59 with the exterior of the main body 97, is used as an engagement recess for engagement with the mechanical key 99. Accordingly, the engagement recess is easily formed by the engagement window 65 extending through the main body 97, and the shape of the engagement recess is simplified. This ensures miniaturization of the portable device 95.

(20) When the mechanical key 99 is accommodated in the mechanical key retainer 59, the hook 111 is exposed from the mechanical key 99 through the spring hole 127 and the engagement window 65. Accordingly, the accommodation of the mechanical key 99 in the mechanical key retainer 59 may easily be confirmed by checking whether or not the hook 111 is exposed through the engagement window 65.

A fourth embodiment of the present invention will now be described with reference to FIGS. 19 to 26. To avoid redundancy, like or same reference numerals are given to those components that are the same as the corresponding components of the first through third embodiments.

Figure 19:
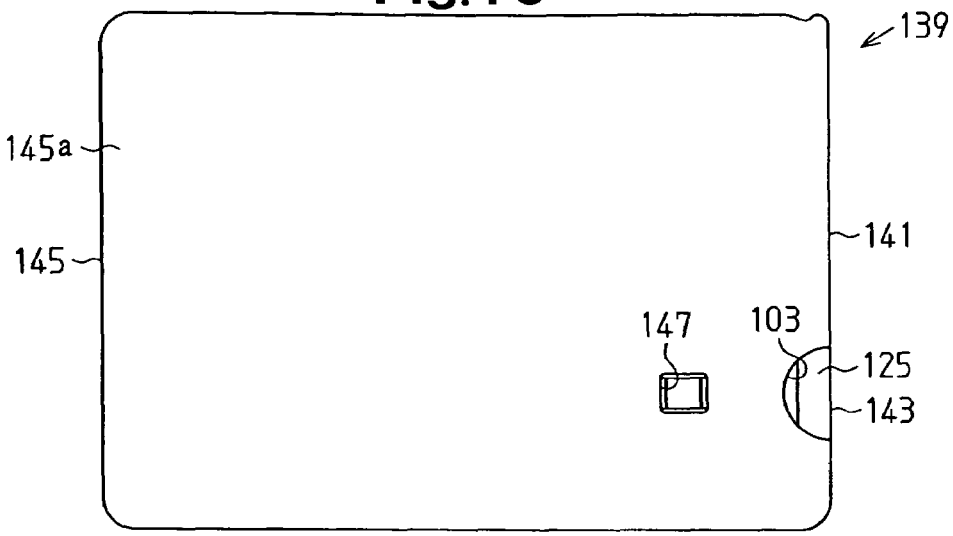
FIG. 19 is a plan view showing a portable device according to a fourth embodiment of the present invention.
Figure 20:
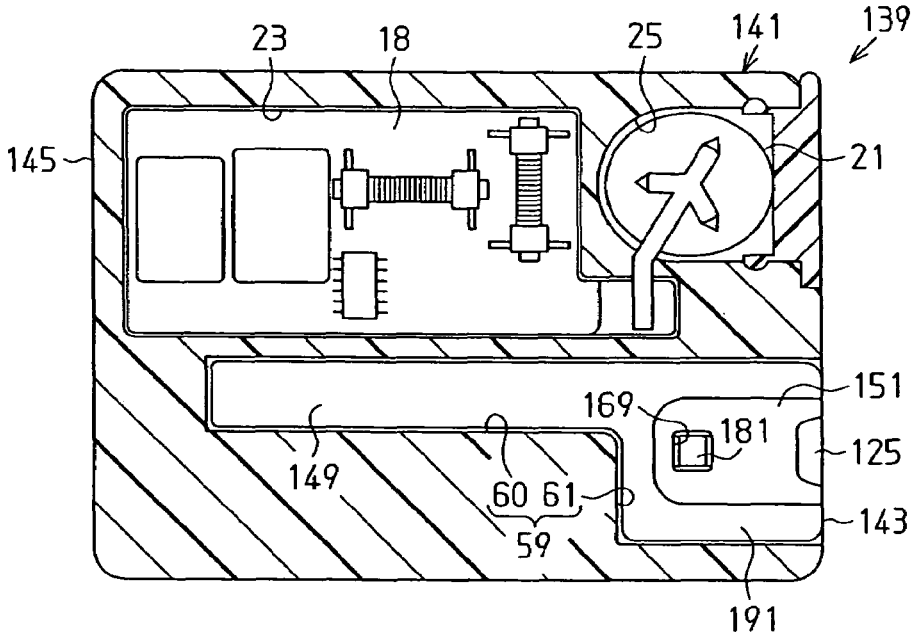
FIG. 20 is a cross-sectional view of the portable device shown in FIG. 19.

As shown in FIG. 19, in the same manner as the above embodiments, a portable device 139 of the present embodiment includes a main body 141 and a mechanical key 143. As shown in FIG. 20, the main body 141 includes a case 145, a circuit board 18, and a battery 21. In the same manner as in the above embodiments, the case 145 is card-shaped and includes a circuit board retainer 23 and a battery retainer 25. Further, the case 145 includes a mechanical key retainer 59, which is similar to that of the second embodiment. The mechanical key retainer 59 includes a blade retaining portion 60 and a handle retaining portion 61.

Further, as shown in FIG. 19, the case 145 includes a seventh cutaway portion 103 in the same manner as the third embodiment. At the same position as the engagement window 65 of the second and third embodiments, an engagement window 147 extends through the upper wall 145*a* of the case 145 into the handle retaining portion 61 of the mechanical key retainer 59 (refer to FIG. 20). The engagement window 147 has a rectangular cross-section.

Figure 21:
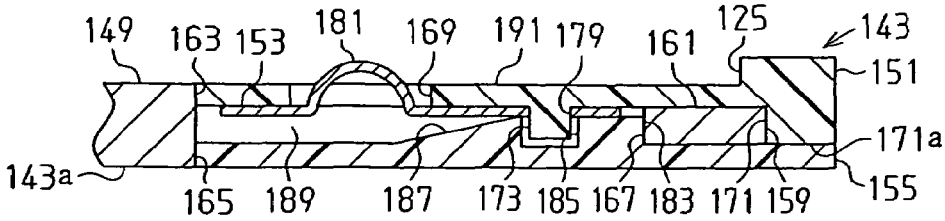
FIG. 21 is a cross-sectional view of a mechanical key of the portable device shown in FIG. 19.
Figure 22:
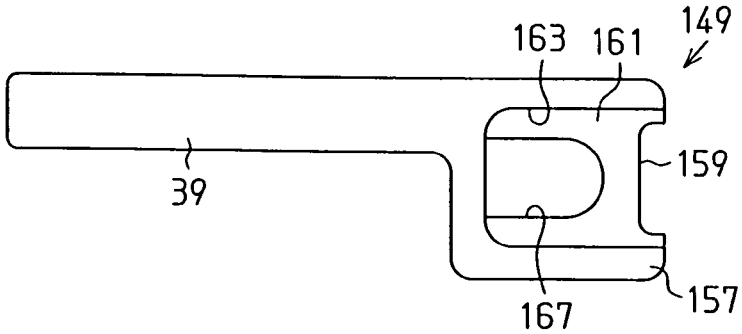
FIG. 22 is a plan view showing a key plate of the mechanical key shown in FIG. 21.

As shown in FIGS. 20 and 21, in the preferred embodiment, the mechanical key 143 includes a key plate 149, an upper grip member 151, a leaf spring 153, which is a metal plate, and a lower grip member 155. Referring to FIG. 22, in the same manner as the above embodiments, the key plate 149 is made of metal and includes a blade 39 and a handle base 157. Further, in the same manner as the first embodiment, although not shown in the drawings, the blade 39 is machined (notched and grooved).

The handle base 157 is formed by eliminating the second cutaway portion 43 from the handle base 158 of the third embodiment. An eighth cutaway portion 159, which is wider than the second cutaway portion 43, is formed at the same position as the second cutaway portion 43 in the handle base 115 of the third embodiment. In the same manner as the handle base 115 of the third embodiment, a thin portion 161 extends from the eighth cutaway portion 159 in the insertion direction of the mechanical key 143. In the present embodiment, the thin portion 161 is generally rectangular. The two corners at the front side of the thin portion 161 with respect to the insertion direction of the mechanical key 143 are rounded.

Referring to FIGS. 21 and 22, the handle base 157 has an upper fitting pit 163 and a lower fitting pit 165 defined on opposite sides of the thin portion 161. The upper fitting pit 163 and the lower fitting pit 165 are each generally rectangular and each have two rounded front corners with respect to the insertion direction of the mechanical key 143. When the mechanical key 143 is accommodated in the mechanical key retainer 59, the upper fitting pit 163 and the lower fitting pit 165 respectively face towards the upper wall 145*a* (refer to FIG. 19) and lower wall (not shown) of the case 145.

In the same manner as the handle base 115 of the third embodiment, a fitting hole 167 extends through the thin portion 161 of the handle base 157. In the present embodiment, the fitting hole 167 has a bell-shaped cross-section. The front end of the fitting hole 167, with respect to the insertion direction of the mechanical key 143, is straight. When the mechanical key 143 is accommodated in the mechanical key retainer 59 (refer to FIG. 20), the fitting hole 167 is overlapped with the engagement window 147 of the case 145 (refer to FIG. 19).

Figure 23:
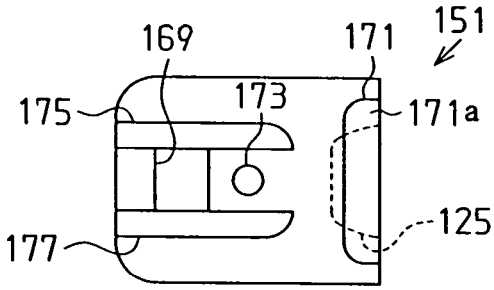
FIG. 23 is a bottom view showing an upper grip member for the mechanical key shown in FIG. 21.

Referring to FIGS. 21 and 23, the upper grip member 151 is formed from resin and shaped to fit into and fill the upper fitting pit 163. In the same manner as the third embodiment, a gripping projection 125 projects from the upper grip member 151 away from the key plate 149.

A rectangular spring hole 169 extends through the upper grip member 151. The size of the rectangular spring hole 169 is substantially the same as the size of the engagement window 147 of the case 145 (refer to FIG. 19). When the mechanical key 143 is accommodated in the mechanical key retainer 59 (refer to FIG. 20), the rectangular spring hole 169 is overlapped with the engagement window 147. Further, a third fused projection 171 projects from the upper grip member 151 towards the key plate 149. The third fused projection 171 has an arcuate cross-section when viewed from above the mechanical key 143. When the upper grip member 151 is fitted in the upper fitting pit 163 of the key plate 149, the third fused projection 171 is shaped and positioned to be engaged with the eighth cutaway portion 159 (FIG. 22). Further, the projecting length of the third fused projection 171 is substantially the same as the thickness of the thin portion 161 in the key plate 149.

A fulcrum projection 173 also projects from the upper grip member 151 toward the key plate 149. The fulcrum projection 173 is cylindrical and formed between the rectangular spring hole 169 and third fused projection 171. The projecting length of the fulcrum projection 173 is substantially the same as that of the third fused projection 171.

As shown in FIG. 23, fourth and fifth fused projections 175 and 177 project from the upper grip member 151 towards the key plate 149. The fourth and fifth fused projections 175 and 177 are belt-shaped, symmetric to each other, and formed to sandwich the rectangular spring hole 169 and the fulcrum projection 173. The fourth and fifth fused projections 175 and 177 are shaped to enable fitting into the fitting hole 167 of the key plate 149 (refer to FIG. 22). When the upper grip member 151 is fitted into the upper fitting pit 163 of the key plate 149, the fourth and fifth fused projections 175 and 177 are fitted into the fitting hole 167. The projecting lengths of the fourth and fifth fused projections 175 and 177 are substantially the same as that of the third fused projection 171.

Figure 24:
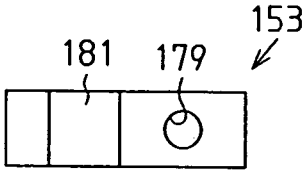
FIG. 24 is a plan view showing a leaf spring for the mechanical key shown in FIG. 21.

As shown in FIGS. 21 and 24, the leaf spring 153 is a generally rectangular and thin plate made of metal. The leaf spring 153 is sized to fit into the fitting hole 167 of the key plate 149 (refer to FIG. 22). A fulcrum projection hole 179 extends through the leaf spring 153. The fulcrum projection hole 179 is located near one end of the leaf spring 153. Further, the fulcrum projection hole 179 has a diameter that is slightly greater than that of the fulcrum projection 173. An arch 181 is formed on the leaf spring 153. The arch 181 is located near the other end of the leaf spring 153. The leaf spring 153 is curved to form the arch 181, which has a semicircular cross-section. In the present embodiment, the leaf spring 153 is formed through pressing.

Figure 25:
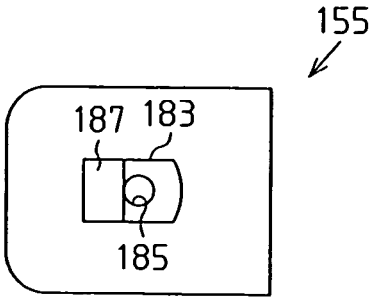
FIG. 25 is a plan view showing a lower grip member for the mechanical key shown in FIG. 21.
Figure 26:
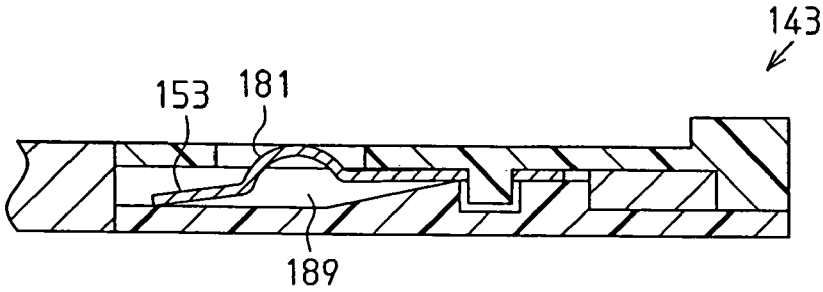
FIG. 26 is a cross-sectional diagram showing the operation of the mechanical key shown in FIG. 21.

Referring to FIGS. 21 and 25, the lower grip member 155 is formed from resin and shaped to enable fitting into the lower fitting pit 165 of the key plate 149. When the lower grip member 155 is fitted into the lower fitting pit 165, the lower grip member 155 fills the lower fitting pit 165 and is flush with the lower surface 143*a* of the mechanical key 143. A leaf spring support 183 projects from the lower grip member 155 towards the key plate 149. The leaf spring support 183 is shaped so that when the lower grip member 155 is fitted in the lower fitting pit 165, the leaf spring support 183 is fitted between the fourth and fifth fused projections 175 and 177 of the upper grip member 151 (refer to FIG. 23). Further, the leaf spring support 183 includes a cylindrical fulcrum projection receptacle 185 for receiving the fulcrum projection 173 when the lower grip member 155 is fitted into the lower fitting pit 165. An inclined surface 187 is formed on the front side of the mechanical key 143 with respect to the insertion direction of the mechanical key 143. The height of the inclined surface 187 increases toward the rear.

The lower grip member 155 is fitted into the lower fitting pit 165 of the key plate 149. In this state, the leaf spring support 183 of the lower grip member 155 is fitted between the fourth and fifth fused projections 175 and 177 of the upper grip member 151. Further, the fulcrum projection 173 of the upper grip member 151 is fitted in the fulcrum projection receptacle 185 of the lower grip member 155. In this state, the third to fifth fused projections 171, 175, and 177 of the upper grip member 151 are fused to the lower grip member 155. As shown in FIG. 21, a retraction cavity 189, which is in communication with the rectangular spring hole 169, is formed between the upper grip member 151 and the lower grip member 155.

The leaf spring 153 is located between the upper grip member 151 and the lower grip member 155. More specifically, in a state in which the fulcrum projection 173 of the upper grip member 151 is inserted through the fulcrum projection hole 179, by fitting the fulcrum projection 173 into the fulcrum projection receptacle 185 of the lower grip member 155, the leaf spring 153 is fixed in a cantilevered state between the upper grip member 151 and the lower grip member 155. The leaf spring 153 is arranged between the fourth and fifth fused projections 175 and 177. The arch 181 of the leaf spring 153 projects toward the upper grip member 151. Further, the leaf spring 153 is positioned and sized to enable insertion through the rectangular spring hole 169 of the upper grip member 151. Accordingly, as shown in FIGS. 20 and 21, the leaf spring 153 is exposed from the mechanical key 143 through the rectangular spring hole 169.

The application of force to the leaf spring 153 toward the lower grip member 155 resiliently flexes the leaf spring 153 toward the retraction cavity 189 about the fulcrum projection hole 179. In the mechanical key 143, the upper grip member 151, the leaf spring 153, and the lower grip member 155 form a handle 191.

To insert the mechanical key 143 into the mechanical key retainer 59 of the case 145, the handle 191 of the mechanical key 143 is first held with the fingers, and the mechanical key 143 is inserted into the mechanical key retainer 59 from the blade 39 of the key plate 149. As the mechanical key 143 moves in the mechanical key retainer 59, the arch 181 of the leaf spring 153, which projects outward from the handle 191, is forced against the wall surface of the mechanical key retainer 59. As a result, the leaf spring 153 is resiliently flexed, and the arch 181 is moved toward the retraction cavity 189 of the mechanical key 143. This lowers resistance when the mechanical key 143 is inserted into the mechanical key retainer 59 and enables smooth movement of the mechanical key 143.

Further insertion of the mechanical key 143 into the mechanical key retainer 59 arranges the blade 39 and the handle 191 respectively in the blade retaining portion 60 and the handle retaining portion 61. Then, the arch 181 of the leaf spring 153 in the mechanical key 143 reaches a position where the arch 181 faces toward the engagement window 147 of the case 145. The resilient force of the leaf spring 153 causes engagement with the engagement window 147 and resiliently restores the leaf spring 153 to its original shape. This prevents the mechanical key 143 from falling out of the mechanical key retainer 59. In this state, as shown in FIG. 19, the gripping projection 125 is engaged with and exposed from the seventh cutaway portion 103 of the case 145.

To remove the mechanical key 143 from the mechanical key retainer 59, the gripping projection 125 exposed from the seventh cutaway portion 103 is held with the fingers to apply force to the mechanical key 143 for removing the mechanical key 143 from the mechanical key retainer 59. As a result, force greater than the engaging force of the arch 181 of the leaf spring 153 with the engagement window 147 is applied to the arch 181. This resiliently flexes the arch 181 of the leaf spring 153 into the retraction cavity 189 and disengages the arch 181 from the engagement window 147. Further application of force to the mechanical key 143 moves the mechanical key 143 in the mechanical key retainer 59 with the arch 181 located in the retraction cavity 189 until the mechanical key 143 is removed from the mechanical key retainer 59.

The present embodiment has the advantages described below.

(21) When the main body 141 of the mechanical key 143 is accommodated in the mechanical key retainer 59, the arch 181 arranged on the leaf spring 153 in the mechanical key 143 is engaged with the engagement window 147 of the mechanical key retainer 59. Accordingly, the engagement of the mechanical key 143 and the main body 141 is enabled with a simple structure, and the need for a locking means is eliminated. This reduces the number of components in the portable device 139, enables miniaturization, and improves portability.

(22) The leaf spring 153 having the arch 181 is formed from a resilient metal. Accordingly, when the mechanical key 143 is accommodated in mechanical key retainer 59 of the main body 141, the leaf spring 153 is resiliently flexed to enable smooth movement of the mechanical key 143. The arch 181, which functions as an engagement projection that engages the engagement window 147, is formed integrally with the leaf spring 153. This reduces the number of components in the portable device 139. Further, since the leaf spring 153 is made of metal, the leaf spring 153 has higher durability compared to when the leaf spring 153 is made of a resin. This further ensures the engagement between the mechanical key 143 and the main body 141.

(23) The mechanical key 143 includes the retraction cavity 189. Accordingly, when inserting the mechanical key 143 into the mechanical key retainer 59 of the main body 141, the leaf spring 153 enters the retraction cavity 189. This ensures resilient flexing of the leaf spring 153 and enables the mechanical key 143 to move further smoothly.

(24) The case 145 of the main body 141 includes the seventh cutaway portion 103. Accordingly, when the mechanical key 143 is accommodated in the mechanical key retainer 59, part of the mechanical key 143 is exposed from the seventh cutaway portion 103. As a result, by holding and applying force to the exposed part, the mechanical key 143 may easily be removed from the mechanical key retainer 59.

(25) The engagement window 147, which communicates the mechanical key retainer 59 with the exterior of the main body 141, is used as an engagement recess for engagement with the mechanical key 143. Accordingly, the engagement recess is easily formed by the engagement window 147 extending through the main body 141, and the shape of the recess is simplified. This ensures miniaturization of the portable device 139.

(26) The fulcrum projection hole 179, which functions as the fulcrum of the leaf spring 153, is located rearward from the arch 181 with respect to the insertion direction of the mechanical key 143. Accordingly, the distance from the fulcrum projection hole 179 to the location in which the mechanical key 143 receives external force is longer during insertion of the mechanical key 143 than during removal of the mechanical key 143. As a result, the arch 181 is resiliently flexed with a smaller force during insertion of the mechanical key 143 than during removal of the mechanical key 143. This prevents the mechanical key 143 from falling out of the mechanical key retainer 59 and facilitates insertion of the mechanical key 143 into the mechanical key retainer 59.

(27) When the mechanical key 143 is accommodated in the mechanical key retainer 59, the arch 181 is exposed from the mechanical key 143 through the engagement window 147. Accordingly, the accommodation of the mechanical key 143 in the mechanical key retainer 59 may easily be confirmed by checking whether or not the arch 181 is exposed from the engagement window 147.

A fifth embodiment of the present invention will now be described with reference to FIGS. 27 to 31. To avoid redundancy, like or same reference numerals are given to those components that are the same as the corresponding components of the first through fourth embodiments.

Figure 27:
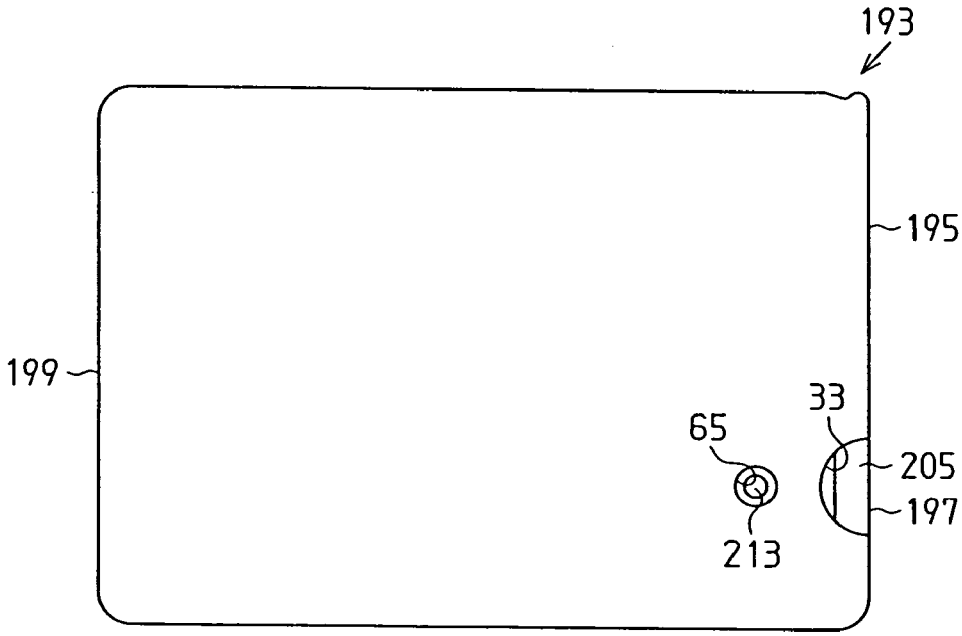
FIG. 27 is a plan view showing a portable device according to a fifth embodiment of the present invention.
Figure 28:
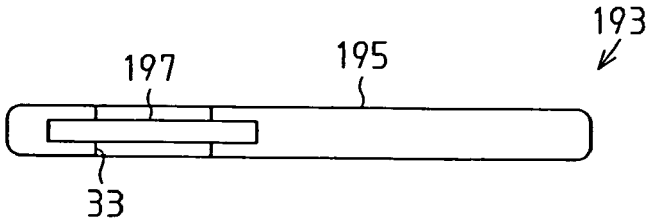
FIG. 28 is a side view showing the portable device of FIG. 27.
Figure 29:
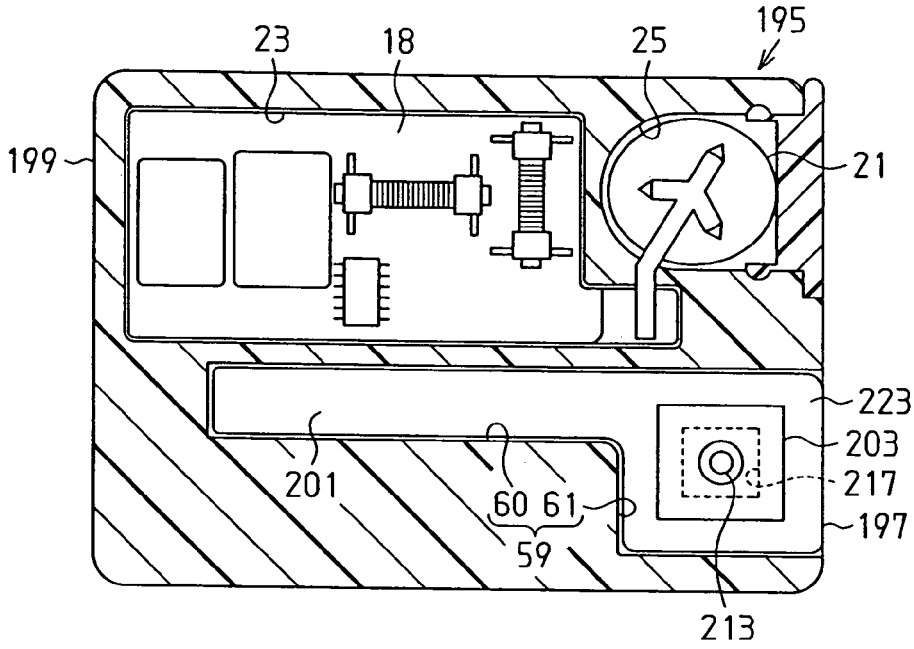
FIG. 29 is a cross-sectional view of the portable device shown in FIG. 27.

As shown in FIGS. 27 and 28, in the same manner as the above embodiments, a portable device 193 of the present embodiment includes a main body 195 and a mechanical key 197. As shown in FIG. 29, the main body 195 includes a case 199, a circuit board 18, and a battery 21. In the same manner as in the above embodiments, the case 199 is card-shaped and includes a circuit board retainer 23 and a battery retainer 25. Further, the case 199 includes a mechanical key retainer 59, which is similar to that of the second embodiment. The mechanical key retainer 59 includes a blade retaining portion 60 and a handle retaining portion 61.

Figure 30:
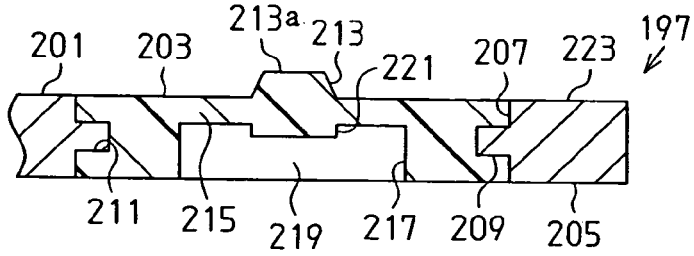
FIG. 30 is a cross-sectional view of a mechanical key of the portable device shown in FIG. 27.
Figure 31:
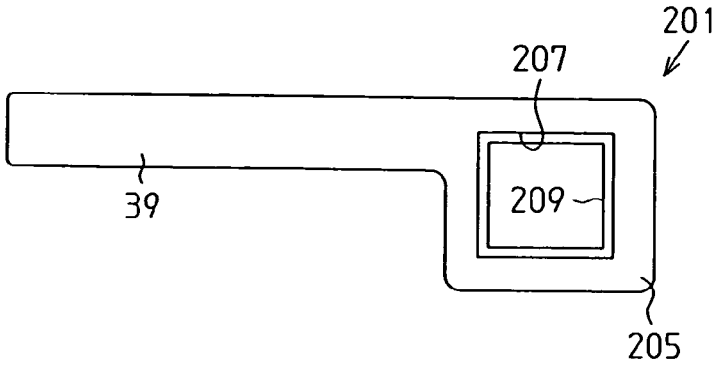
FIG. 31 is a plan view showing a key plate of the mechanical key shown in FIG. 30.

Further, as shown in FIGS. 27 and 28, the case 199 includes a first cutaway portion 33 in the same manner as in the first embodiment. Further, an engagement window 65 extends through the case 199 in the same manner as in the second and third embodiments. As shown in FIGS. 29 and 30, in the present embodiment, the mechanical key 197 includes a key plate 201 and a flexible member 203. Referring to FIG. 31, in the same manner as in the above embodiments, the key plate 201 is made of a metal and includes a blade 39 and a handle base 205. Further, in the same manner as in the above embodiments, although not shown in the drawings, the blade 39 is machined (notched and grooved).

The handle base 205 is formed by eliminating the eighth cutaway portion 159, the thin portion 161, and the fitting hole 167 from the handle base 157 of the fourth embodiment. A flexible member receptacle 207 extends through the middle part of the handle base 205. The flexible member receptacle 207 has a substantially square cross-section. The handle base 205 further includes a frame-like lip 209, which extends along the walls of the flexible member receptacle 207. As shown in FIG. 30, the lip 209 is formed to have a thickness that is less than that of the key plate 201. Further, the lip 209 is located at a median position with respect to the thickness-wise direction of the flexible member receptacle 207.

As shown in FIGS. 29 and 30, the flexible member 203 is formed from a resilient resin material such as an elastomer. The flexible member 203 has a substantially square cross-section and is shaped to fit into the flexible member receptacle 207 of the key plate 201. A groove 211, which is engageable with the lip 209 of the handle base 205, extends along the periphery of the flexible member 203. The flexible member 203 is received in the flexible member receptacle 207 in a state in which the groove 211 and lip 209 are engaged with each other. The flexible member 203 may be attached to the handle base 205 through any process such as insert molding. Accordingly, the flexible member 203 is engaged with the handle base 205 by a relatively high engaging force.

An engagement projection 213 projects from the flexible member 203. The engagement projection 213 is shaped and positioned in a manner enabling insertion into the engagement window 65 of the case 199 (refer to FIG. 27) when the mechanical key 197 is accommodated in the mechanical key retainer 59 (refer to FIG. 29). More specifically, the engagement projection 213 is shaped into a truncated cone and has a top surface 213*a* with a diameter that is slightly smaller than the diameter of the engagement window 65 (refer to FIG. 27).

The flexible member 203 has a thin portion 215, which extends outward from the engagement projection 213. The thin portion 215 has a generally square cross-section when viewing the mechanical key 197 from above. A box-shaped recess 217 is formed in the flexible member 203 on the opposite side of the engagement projection 213 and thin portion 215. A retraction cavity 219 is defined in the recess 217. The flexible member 203 also has a support projection 221 projecting downward into the retraction cavity 219 from the surface of the recess 217 that is opposite to the engagement projection 213. The support projection 221 has a circular cross-section. The handle base 205 and the flexible member 203 form a handle 223 of the mechanical key 197.

To insert the mechanical key 197 into the mechanical key retainer 59 of the case 199, the handle 223 of the mechanical key 197 is first held with the fingers, and the mechanical key 197 is inserted into the mechanical key retainer 59 from the blade 39 of the key plate 201. As the mechanical key 197 moves in the mechanical key retainer 59, the engagement projection 213, which projects outward from the handle 223, is forced against the wall surface of the mechanical key retainer 59. As a result, the engagement projection 213 and thin portion 215 are resiliently flexed, and the engagement projection 213 is moved toward the retraction cavity 219 of the mechanical key 197. This lowers resistance when the mechanical key 197 is inserted into the mechanical key retainer 59 and enables smooth movement of the mechanical key 197.

Further insertion of the mechanical key 197 into the mechanical key retainer 59 arranges the blade 39 and the handle 223 respectively in the blade retaining portion 60 and the handle retaining portion 61. Then, the engagement projection 213 of the mechanical key 197 reaches a position where the engagement projection 213 faces toward the engagement window 65 of the case 199. Then, the flexed engagement projection 213 and thin portion 215 are resiliently restored to their original positions and the engagement projection 213 engages with the engagement window 65. This prevents the mechanical key 197 from falling out of the mechanical key retainer 59. In this state, as shown in FIG. 27, part of the handle base 205 of the mechanical key 197 is exposed from the first cutaway portion 33 of the case 199.

To remove the mechanical key 197 from the mechanical key retainer 59, the part of the handle base 205 exposed from the first cutaway portion 33 is held with the fingers to apply force to the mechanical key 197 for removing the mechanical key 197 from the mechanical key retainer 59. As a result, force greater than the engaging force of the engagement projection 213 and the engagement window 65 is applied to the engagement projection 213. This resiliently flexes the engagement projection 213 into the retraction cavity 219 and disengages the engagement projection 213 from the engagement window 65. Further application of force to the mechanical key 197 moves the mechanical key 197 in the mechanical key retainer 59 with the engagement projection 213 located in the retraction cavity 219 until the mechanical key 197 is removed from the mechanical key retainer 59.

The present embodiment has the advantages described below.

(28) When the mechanical key 197 is accommodated in the mechanical key retainer 59 of the main body 195, the engagement projection 213 arranged on the mechanical key 197 is engaged with the engagement window 65 of the mechanical key retainer 59. Accordingly, the engagement of the mechanical key 197 and the main body 195 is enabled with a simple structure, and the need for an engaging means such as a locking means is eliminated. This reduces the number of components in the portable device 193, enables miniaturization, and improves portability.

(29) The engagement projection 213 of the mechanical key 197 is formed from a resilient resin material such as an elastomer. Accordingly, when the mechanical key 197 is accommodated in the mechanical key retainer 59 of the main body 195, the engagement projection 213 and its periphery are resiliently flexed to enable smooth movement of the mechanical key 197.

(30) The retraction cavity 219 is formed next to the engagement projection 213 in the mechanical key 197. Accordingly, when inserting the mechanical key 197 into the mechanical key retainer 59 of the main body 195, the engagement projection 213 is resiliently flexed into the retraction cavity 219. The movement of the engagement projection 213 enables smooth movement of the mechanical key 197.

(31) The case 199 of the main body 195 includes the first cutaway portion 33. Accordingly, when the mechanical key 197 is accommodated in the mechanical key retainer 59, part of the mechanical key 197 is exposed through the first cutaway portion 33. Thus, by holding and applying force to the exposed part, the mechanical key 197 is easily removed from the mechanical key retainer 59.

(32) The engagement projection 213 of the mechanical key 197 is formed integrally with the flexible member 203, which has a relatively high friction coefficient thereby increasing the gripping force when using the mechanical key 197. This reduces the number of components in the mechanical key 197, enables miniaturization of the portable device 193, and improves portability.

(33) The engagement window 65, which communicates the mechanical key retainer 59 with the exterior of the main body 195, is used as an engagement recess engaged with the mechanical key 197. Accordingly, the engagement recess is easily formed by the engagement window 65 extending through the main body 195, and the shape of the recess is simplified. This ensures miniaturization of the portable device 193.

(34) When the mechanical key 197 is accommodated in the mechanical key retainer 59, the engagement projection 213 is exposed from the case 199 through the engagement window 65. Accordingly, the accommodation of the mechanical key 197 in the mechanical key retainer 59 may easily be confirmed by checking whether or not the engagement projection 213 is exposed through the engagement window 65.

It should be apparent to those skilled in the art that the present invention may be embodied in many other specific forms without departing from the spirit or scope of the invention. Particularly, it should be understood that the present invention may be embodied in the following forms.

In the first, second, fourth, and fifth embodiments, the engagement projections (i.e., the engagement projections 50 and 213, the spherical portion 91, and the arch 181) are arranged on the mechanical keys 14, 55, 143, and 197. However, the engagement projections may be arranged on the main bodies 12, 54, 141, and 195 instead. In such cases, engagement recesses, which receive the engagement projections, are arranged on the mechanical keys 14, 55, 143, and 197.

In the first to fifth embodiments, the engagement projections 50 and 213, the spherical portion 91, the hook 111, and the arch 181 are formed from resilient materials. However, the engagement projections 50 and 213, the spherical portion 91, the hook 111, and the arch 181 may be formed from materials that are not resilient.

In the first to fifth embodiments, the mechanical keys 14, 55, 99, 143, and 197 respectively include the retraction cavities 51*a*, 82, 135, 189, and 219. However, the mechanical keys 14, 55, 99, 143, and 197 do not have to include the retraction cavities 51*a*, 82, 135, 189, and 219.

In the first to fifth embodiments, the main bodies 12, 54, 97, 141, and 195 include the cutaway portions 33, 62, and 103. However, the main bodies 12, 54, 97, 141, and 195 do not have to include the cutaway portions 33, 62, and 103. Further, in the first to fifth embodiments, the cutaway portions 33, 62, and 103 may have any shape as long as the mechanical keys 14, 55, 99, 143, and 197 can easily be removed from the mechanical key retainers 27 and 59. For example, the cutaway portion 103 may be shaped to have a rectangular cross-section. When changing the shapes of the cutaway portions 33, 62, and 103, the shapes of the bent portion 73 and the gripping projection 125 may be changed accordingly. For example, the gripping projection 125 may have a rectangular cross-section.

In the second to fifth embodiments, the engagement windows 65 and 147 function as engagement recesses for receiving the engagement projections of the mechanical keys 55, 99, 143, and 197. However, engagement recesses having other shapes may be employed. For example, engagement recesses that do not extend through the cases 57, 101, 145, and 199 may be employed.

In the first and fifth embodiments, the engagement projections 50 and 213 are respectively formed integrally with the grip 37 and the flexible member 203, which have a relatively high friction coefficient. However, the engagement projections 50 and 213 may respectively be formed separately from the grip 37 and the flexible member 203

In the second and fourth embodiments, the spherical portion 91 and the arch 181 are respectively formed by pressing the engagement plate 69 and the leaf spring 153. However, the spherical portion 91 and the arch 181 may be formed through other processes. Further, the spherical portion 91 and the arch 181 may respectively be formed separately from the engagement plate 69 and the leaf spring 153.

In the second embodiment, the spherical portion 91 has a spherical surface. However, the spherical portion 91 may have other shapes. For example, the spherical portion 91 may have the shape of a truncated cone.

Figure 32:
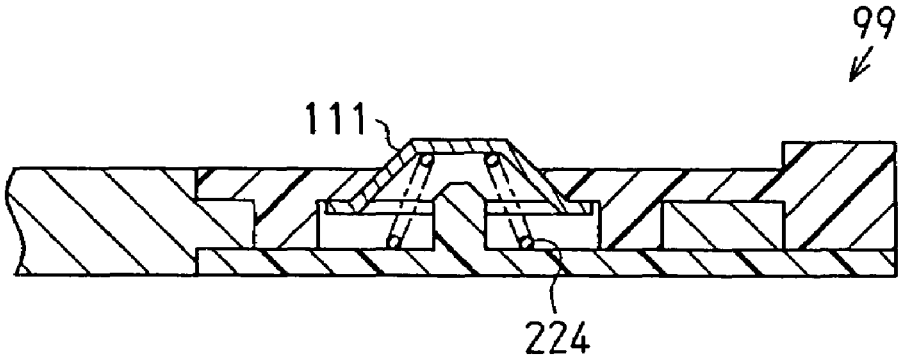
FIG. 32 is a cross-sectional view of a modified mechanical key.

In the third embodiment, the spring 109 has a constant diameter. However, as shown in FIG. 32, a conical spring 224, the diameter of which decreases as the hook 111 becomes closer, may be employed instead. In such a case, when the force applied to the hook 111 resiliently flexes the spring 224, the overlapped windings of the spring 224 is small when the spring 224 is compressed. This provides more space in the mechanical key 99.

In the third embodiment, the lower grip member 107 and the upper grip-member 113 are thermally fused and fixed to each other. Instead, the lower grip member 107 and the upper grip member 113 may be formed integrally with each other from the beginning.

Figure 33:
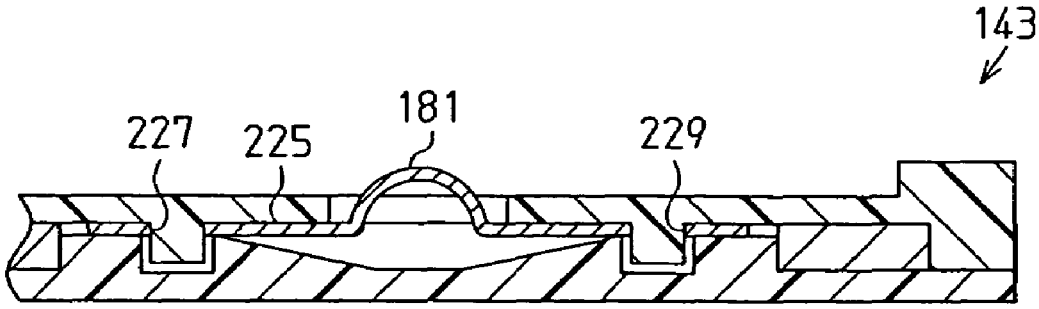
FIG. 33 is a cross-sectional view of a further modified mechanical key.

In the fourth embodiment, the arch 181 is formed on the leaf spring 153. However, the arch 181 may be formed on a metal plate, which is separate from the leaf spring 153. In such a case, as shown in FIG. 33, the arch 181 may be arranged in the middle part of a metal plate 225, and fulcrum projection holes 227 and 229 may be formed in two ends of the metal plate 225. The metal plate 225 is fixed in the mechanical key 143 by the fulcrum projection holes 227 and 229. In this case, the cantilevered structure of the leaf spring 153 is changed to a two-side supporting structure.

In the fourth embodiment, the fulcrum projection hole 179, which functions as the fulcrum of the leaf spring 153, is located towards the rear of the mechanical key 143 with respect to the mechanical key insertion direction. However, the leaf spring 153 may be arranged in the mechanical key 143 so that the fulcrum projection hole 179 is located toward the front of the mechanical key 143.

In the second to fifth embodiments, the spherical portion 91, the hook 111, the arch 181, and the engagement projection 213 are exposed through the engagement windows 65 and 147 and the spring hole 127. However, the spherical portion 91, the hook 111, the arch 181, and the engagement projection 213 may be unexposed. In such a case, the engagement windows 65 and 147 and the spring hole 127 may be covered with a transparent material. This enables visual confirmation of the spherical portion 91, the hook 111, the arch 181, and the engagement projection 213. Thus, the accommodation of the mechanical keys 55, 99, 143, and 197 in the mechanical key retainer 59 may easily be checked.

In the first to fifth embodiments, the portable devices 11, 53, 95, 139, and 193 are card-shaped. However, the portable devices 11, 53, 95, 139, and 193 may have other shapes.

The present examples and embodiments are to be considered as illustrative and not restrictive, and the invention is not to be limited to the details given herein, but may be modified within the scope and equivalence of the appended claims.

What is claimed is:

1. A portable device for communication with a vehicle, the portable device comprising:

a main body;

a mechanical key retainer formed in the main body, said mechanical key retainer including a key handle retaining portion and a key blade retaining portion;

a mechanical key retainable in the mechanical key retainer having a key handle and a key blade, said key blade releasably retained in said key blade retaining portion and said key handle releasably retained in said key handle retaining portion;

a first engagement portion engageable with the mechanical key and formed on the mechanical key retainer; and a second engagement portion engageable with the first engagement portion of the mechanical key retainer and formed on the key handle of the mechanical key;

wherein the mechanical key has a length and a thickness and includes a surface on which the second engagement portion is formed, with the surface extending along a longitudinal direction of the mechanical key and facing toward the first engagement portion in a thicknesswise direction, which is perpendicular to the longitudinal direction, when the mechanical key is retained in the mechanical key retainer;

the key handle includes a retraction cavity arranged adjacent to the second engagement portion, with the retraction cavity being formed to enable resilient flexing of the second engagement portion towards the retraction cavity in the thicknesswise direction when inserting the mechanical key into the mechanical key retainer;

the first and second engagement portions are aligned with each other when the mechanical key is retained in the mechanical key retainer; and the first and second engagement portions cooperate to form a frictional barrier that may be overcome by a longitudinal force on the mechanical key.

2. The portable device according to claim 1, wherein the second engagement portion is resiliently flexible.

3. The portable device according to claim 1, wherein the first engagement portion is a window, and the second engagement portion is a projection.

4. The portable device according to claim 3, wherein the first engagement portion extends outward of the main body from the mechanical key retainer, and the second engagement portion is engaged with the first engagement portion and exposed from the main body through the first engagement portion in a state in which the mechanical key is retained in the mechanical key retainer.

5. The portable device according to claim 1, wherein the mechanical key includes a metal plate attached to the handle, and the second engagement portion is formed on the metal plate.

6. The portable device according to claim 5, wherein the metal plate is a leaf spring.

7. The portable device according to claim 6, wherein the leaf spring is arranged on the handle to extend in the insertion direction of the mechanical key, and the leaf spring has a first end that is free and a second end that is supported by the handle, with the second end being located rearward from the first end with respect to the insertion direction of the mechanical key.

8. The portable device according to claim 1, wherein the mechanical key includes a spring for urging the second engagement portion in a direction for engagement with the first engagement portion, and the second engagement portion is a hook arranged on the spring.

9. The portable device according to claim 8, wherein the spring is formed to have a diameter that decreases as the hook becomes closer.

10. The portable device according to claim 8, wherein the second engagement portion is arranged between the retraction cavity and the first engagement portion in a state in which the mechanical key is retained in the mechanical key retainer.

11. The portable device according to claim 1, wherein the main body includes a cutaway portion for exposing part of the mechanical key, said part of the mechanical key excluding the second engagement portion, in a state in which the mechanical key is retained in the mechanical key retainer.

* * * * *